US011767639B2

(12) United States Patent
Parker et al.

(10) Patent No.: US 11,767,639 B2
(45) Date of Patent: Sep. 26, 2023

(54) COATED PAPERBOARD CONTAINERS HAVING AN AQUEOUS BARRIER COATING

(71) Applicant: WestRock MWV, LLC, Atlanta, GA (US)

(72) Inventors: Steven Parker, Raleigh, NC (US); Jiebin Pang, Glen Allen, VA (US); Natasha G. Melton, Richmond, VA (US); Teresa Krug, Henrico, VA (US); Sergio A. Giuste, Midlothian, VA (US); Wade Harris, Lumberton, TX (US); Terrell J. Green, Raleigh, NC (US)

(73) Assignee: WestRock MWV, LLC, Atlanta, GA (US)

( * ) Notice: Subject to any disclaimer, the term of this patent is extended or adjusted under 35 U.S.C. 154(b) by 772 days.

(21) Appl. No.: 16/733,755

(22) Filed: Jan. 3, 2020

(65) Prior Publication Data

US 2020/0232164 A1 Jul. 23, 2020

Related U.S. Application Data

(60) Provisional application No. 62/793,595, filed on Jan. 17, 2019.

(51) Int. Cl.
*D21H 19/82* (2006.01)
*D21H 19/24* (2006.01)
(Continued)

(52) U.S. Cl.
CPC ..... *D21H 19/826* (2013.01); *D21H 19/24* (2013.01); *D21H 19/84* (2013.01); *D21H 25/06* (2013.01); *B65D 3/08* (2013.01)

(58) Field of Classification Search
CPC ..... D21H 19/826; D21H 19/24; D21H 19/84; D21H 25/06; D21H 19/12; D21H 27/10;
(Continued)

(56) References Cited

U.S. PATENT DOCUMENTS 8,142,615 B2 * 3/2012 Wildlock ..... D21H 27/38 162/124
9,068,105 B2 6/2015 VonFelden et al.
(Continued)

FOREIGN PATENT DOCUMENTS

WO WO 2014005697 1/2014
WO WO 2016170229 10/2016
(Continued)

OTHER PUBLICATIONS

AkzoNobel, media release, "AkzoNobel creates the world's first fully compostable and recyclable paper cup," https://www.akzonobel.com/en/for-media-releases-and-features/akzonobel-creates-worlds-first-fully-compostable-and (Aug. 7, 2014).
(Continued)

*Primary Examiner* — Jose A Fortuna
(74) *Attorney, Agent, or Firm* — Walters & Wasylyna LLC

(57) ABSTRACT

A coated paperboard container includes a paperboard substrate and an aqueous barrier coating on the paperboard substrate. The coated paperboard container has a repulpability yield of 75% accepts or greater, a sidewall seam bond strength of 30 pounds per inch or greater, and a wet rigidity loss of 50% or less.

70 Claims, 11 Drawing Sheets

(51) Int. Cl.
*D21H 19/84* (2006.01)
*D21H 25/06* (2006.01)
*B65D 3/08* (2006.01)

(58) Field of Classification Search
CPC ..... D21H 19/82; D21H 21/16; B65D 3/08; B65D 3/06; B65D 3/14; B31B 50/747
See application file for complete search history.

(56) References Cited

U.S. PATENT DOCUMENTS

| | | | | |
|---|---|---|---|---|
| 9,637,866 | B2 * | 5/2017 | Tilton | C08J 11/06 |
| 9,732,474 | B2 * | 8/2017 | Koenig | D21H 19/12 |
| 10,421,848 | B2 * | 9/2019 | Tilton | C08K 3/26 |
| 10,562,659 | B2 * | 2/2020 | Fortin | D21H 27/16 |
| 10,590,606 | B2 * | 3/2020 | Mongrain | D21H 19/56 |
| 10,633,800 | B2 * | 4/2020 | Tilton | D21H 19/22 |
| 10,961,664 | B2 * | 3/2021 | Deeter | C09D 7/63 |
| 11,136,723 | B2 * | 10/2021 | Pang | D21H 19/40 |
| 11,220,788 | B2 * | 1/2022 | Sundholm | D21H 19/82 |
| 11,242,461 | B2 * | 2/2022 | Zha | C09D 7/68 |
| 2012/0302660 | A1 | 11/2012 | Stanssens et al. | |
| 2014/0272163 | A1 * | 9/2014 | Tilton | B32B 27/10 427/427.4 |
| 2014/0274633 | A1 * | 9/2014 | Tilton | B31B 50/26 493/51 |
| 2015/0111011 | A1 * | 4/2015 | Hoekstra | D21H 19/22 428/207 |
| 2017/0218161 | A1 * | 8/2017 | Tilton | D21H 5/12 |
| 2018/0058010 | A1 * | 3/2018 | Mongrain | D21H 19/56 |
| 2018/0135251 | A1 | 5/2018 | Constant et al. | |
| 2018/0142418 | A1 | 5/2018 | Sundholm et al. | |
| 2018/0245291 | A1 * | 8/2018 | Pang | D21J 1/08 |
| 2019/0271116 | A1 * | 9/2019 | Luyten | D21H 23/70 |
| 2020/0056052 | A1 * | 2/2020 | Zha | C09D 7/68 |
| 2020/0131708 | A1 * | 4/2020 | Triclot | D21H 27/10 |
| 2020/0232164 | A1 * | 7/2020 | Parker | D21H 19/84 |
| 2020/0299902 | A1 * | 9/2020 | Deeter | D21H 21/16 |
| 2022/0025582 | A1 * | 1/2022 | Nyflött | D21H 17/74 |
| 2022/0275165 | A1 * | 9/2022 | Tilton | B32B 27/10 |
| 2022/0297873 | A1 * | 9/2022 | Pang | D21H 19/40 |
| 2022/0355979 | A1 * | 11/2022 | Pang | B65D 3/28 |

FOREIGN PATENT DOCUMENTS

| | | | |
|---|---|---|---|
| WO | WO 2016183314 | 11/2016 | |
| WO | WO-2022240828 A1 * | 11/2022 | B65D 25/14 |

OTHER PUBLICATIONS

Sustainable Fiber Solutions, "ECO SBS," https://sustainablefibersolutions.com/ecosbs/ (2019).

* cited by examiner

COATED PAPERBOARD CONTAINERS HAVING AN AQUEOUS BARRIER COATING

PRIORITY

This application claims priority from U.S. Ser. No. 62/793,595 filed on Jan. 17, 2019, the entire contents of which are incorporated herein by reference.

FIELD

The present application relates to the field of coated paperboard containers and, more particularly, coated paperboard containers having an aqueous barrier coating.

BACKGROUND

Paperboard is used in various packaging applications, such as containers. For example, paperboard is used to form paperboard cups for holding hot or cold beverages.

Paperboard cups for holding hot beverages typically require enhanced liquid barrier properties on an interior surface of the cup to minimize absorption of liquid from the beverage into the paperboard substrate. Paperboard cups for holding cold beverages typically require enhanced liquid barrier properties on an interior surface of the cup to minimize absorption of liquid from the beverage into the paperboard substrate and on an exterior surface of the cup to minimize absorption of liquid from condensate into the paperboard substrate.

The paperboard is typically heat-sealable, making it possible to form paperboard cups on a cup machine. Polyethylene (PE) extrusion coated paperboard currently still dominates in such applications by providing both good barrier and good heat-sealing properties. However, such paperboard cups having a polyethylene extrusion coating have difficulties in repulping due to difficulty of breaking down the polyethylene film during the repulping process, and, thus, are not easily recyclable, causing environmental concerns. Thus, there are increasing demands for alternative solutions including new coating technologies to replace polyethylene extrusion coated paperboard cups.

Accordingly, those skilled in the art continue with research and development in the field of coated paperboard containers.

SUMMARY

In one embodiment, a coated paperboard container includes a paperboard substrate and an aqueous barrier coating on the paperboard substrate. The coated paperboard container has a repulpability yield of 75% accepts or greater, a sidewall seam bond strength of 30 pounds per inch or greater, and a wet rigidity loss of 50% or less.

In another embodiment, a coated paperboard container for holding hot beverages includes a sidewall with a sidewall paperboard substrate and a first aqueous barrier coating. The sidewall paperboard substrate has an interior surface facing an interior of said container and an exterior surface facing an exterior of said container, an upper end, a lower end, a first longitudinal end, and a second longitudinal end. The first aqueous barrier coating is on the interior surface of the sidewall paperboard substrate. The first longitudinal end of the sidewall paperboard substrate is heat sealed, by way of the first aqueous barrier coating, to the second longitudinal end of the sidewall paperboard substrate to form a sidewall seam. The coated paperboard container has a repulpability yield of 75% or greater, a side seam bond strength of 30 pounds per inch or greater, and a wet rigidity loss of 20% or less.

In yet another embodiment, a coated paperboard container for holding cold beverages, includes a sidewall having a sidewall paperboard substrate, a first aqueous barrier coating and a second aqueous barrier coating. The sidewall paperboard substrate has an interior surface facing an interior of said container and an exterior surface facing an exterior of said container, an upper end, a lower end, a first longitudinal end, and a second longitudinal end. The first aqueous barrier coating on the interior surface of the sidewall paperboard substrate. The second aqueous barrier coating on the exterior surface of the sidewall paperboard substrate. The first longitudinal end of the sidewall paperboard substrate is heat sealed, by way of at least one of the first aqueous barrier coating and the second aqueous barrier coating, to the second longitudinal end of the sidewall paperboard substrate to form a sidewall seam. The coated paperboard container has a repulpability yield of 75% or greater, a side seam bond strength of 30 pounds per inch or greater, and a wet rigidity loss of 50% or less.

Other embodiments of the disclosed coated paperboard container will become apparent from the following detailed description, the accompanying drawings and the appended claims.

DETAILED DESCRIPTION

Figure 1:
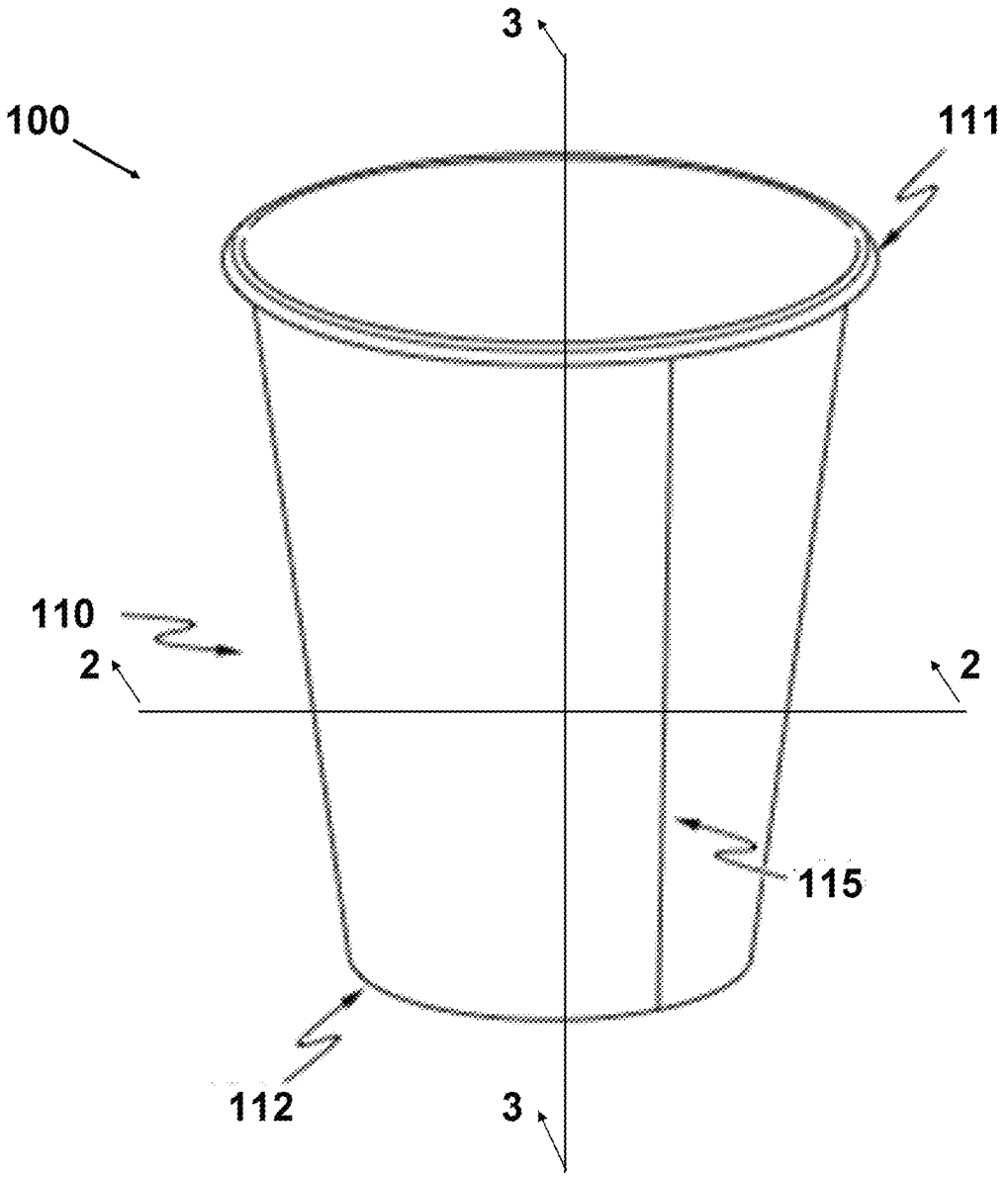
FIG. 1 is a perspective view of a coated paperboard cup for holding hot beverages according to a first embodiment of the present description.
Figure 2:
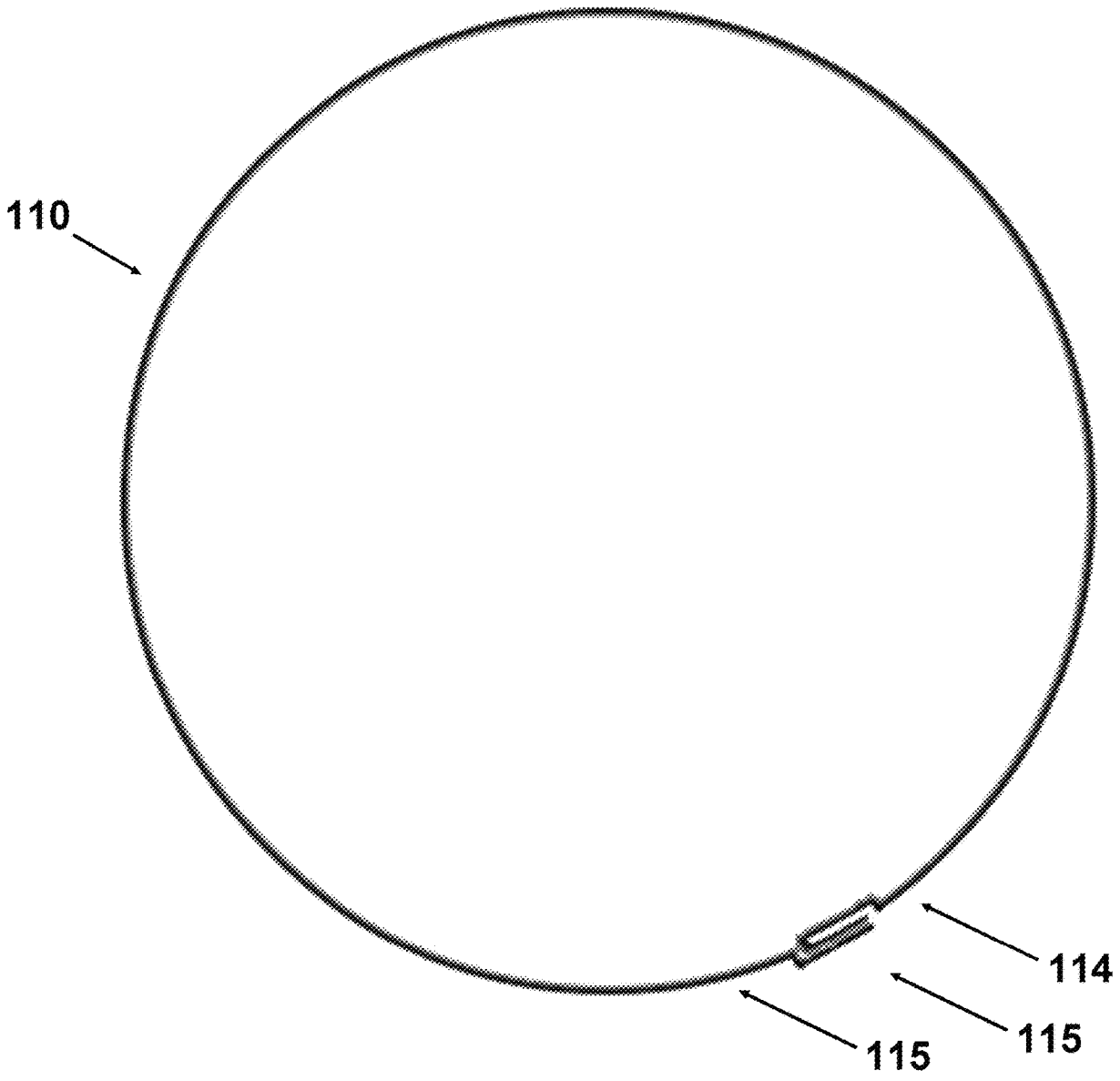
FIG. 2 is a horizontal cross-sectional view of the coated paperboard cup of FIG. 1 along plane 2-2 of FIG. 1.
Figure 3:
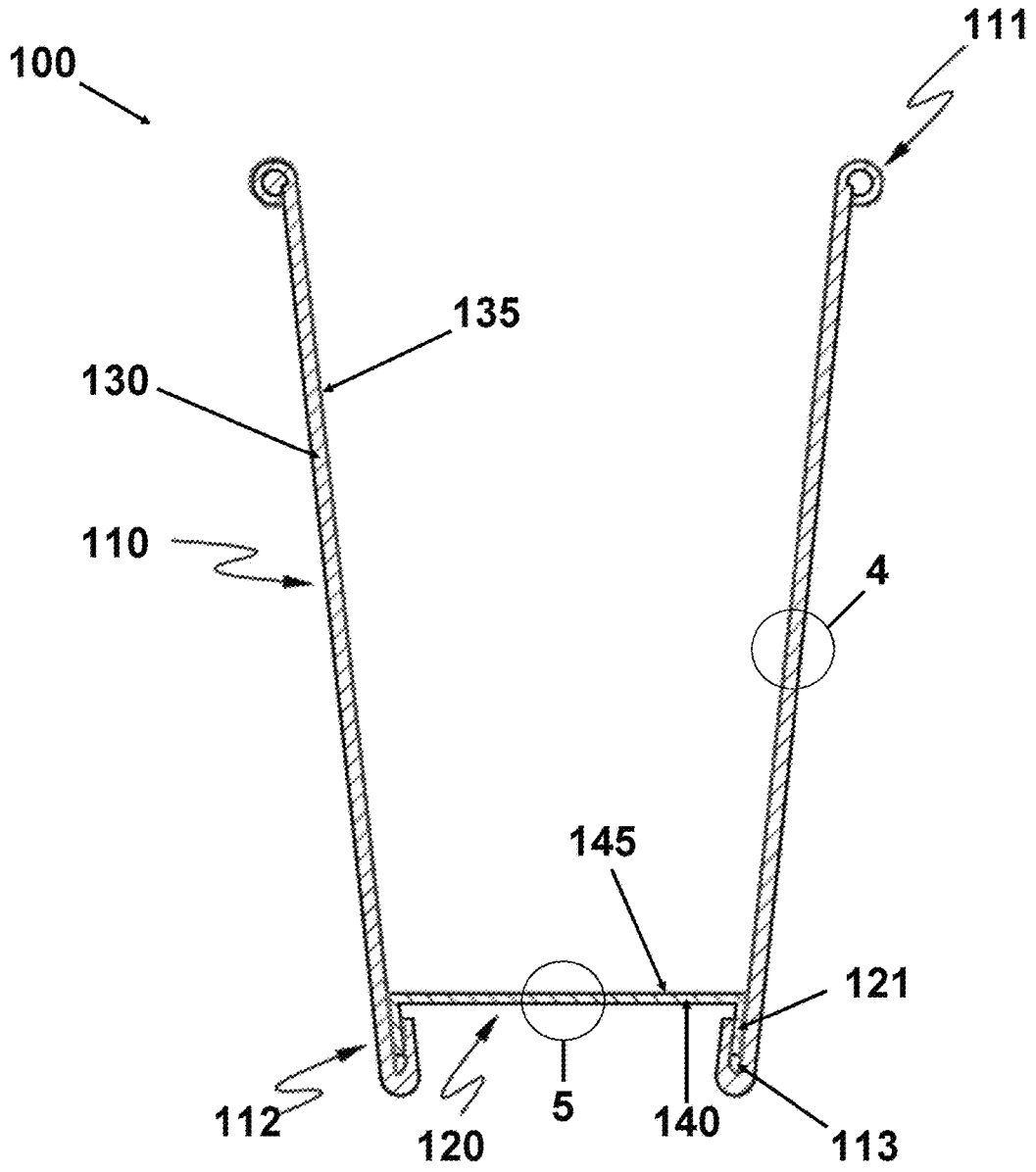
FIG. 3 is a vertical cross-sectional view of the coated paperboard cup of FIG. 1 along plane 3-3 of FIG. 1.
Figure 4A:
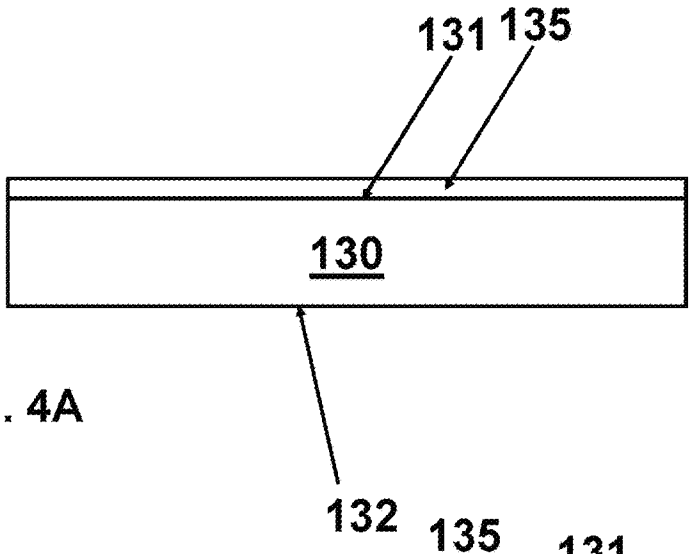
FIG. 4A is a zoomed-in cross-sectional view of the coated paperboard cup at portion "4" of FIG. 3.
Figure 4B:
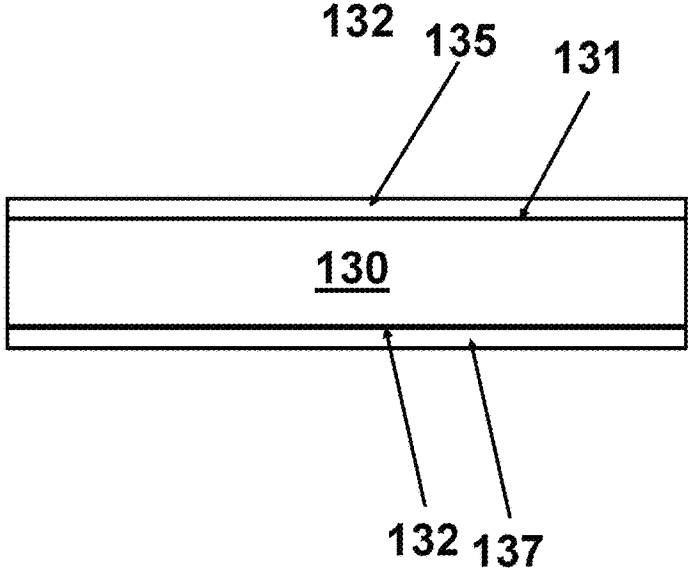
FIG. 4B is a zoomed-in cross-sectional view of an exemplary variation of the coated paperboard cup as shown in FIG. 4A.
Figure 5A:
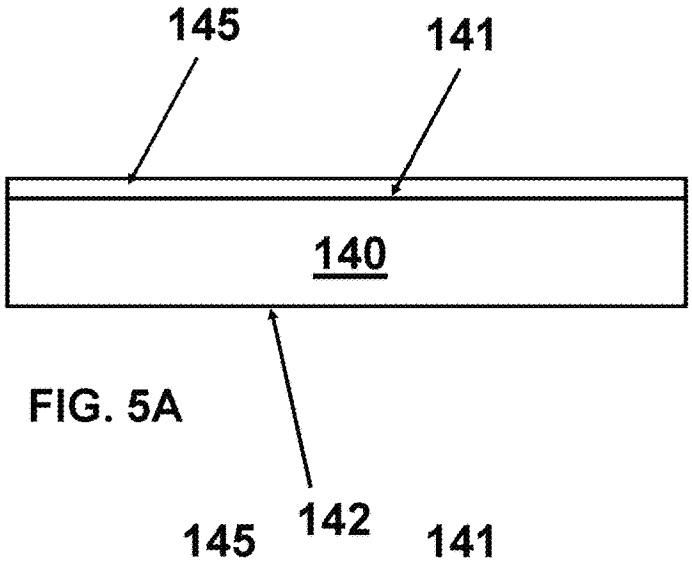
FIG. 5A is a zoomed-in cross-sectional view of the coated paperboard cup at portion "5" of FIG. 3.
Figure 5B:
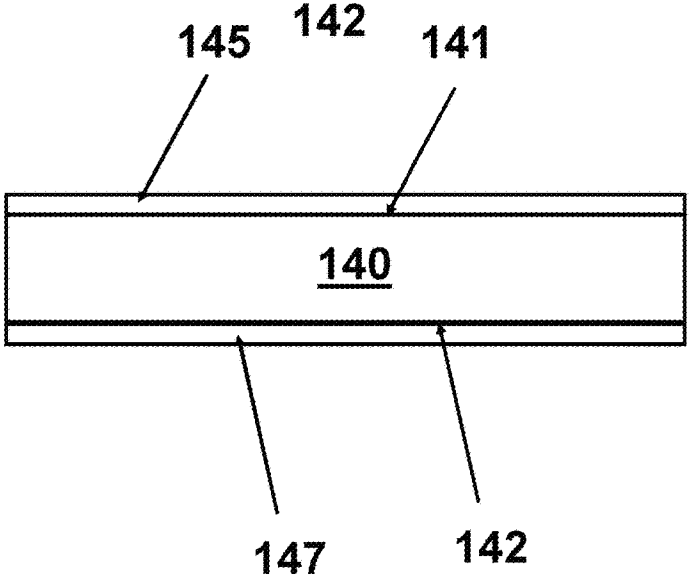
FIG. 5B is zoomed-in cross-sectional view of an exemplary variation of the coated paperboard cup as shown in FIG. 5A.
Figure 6:
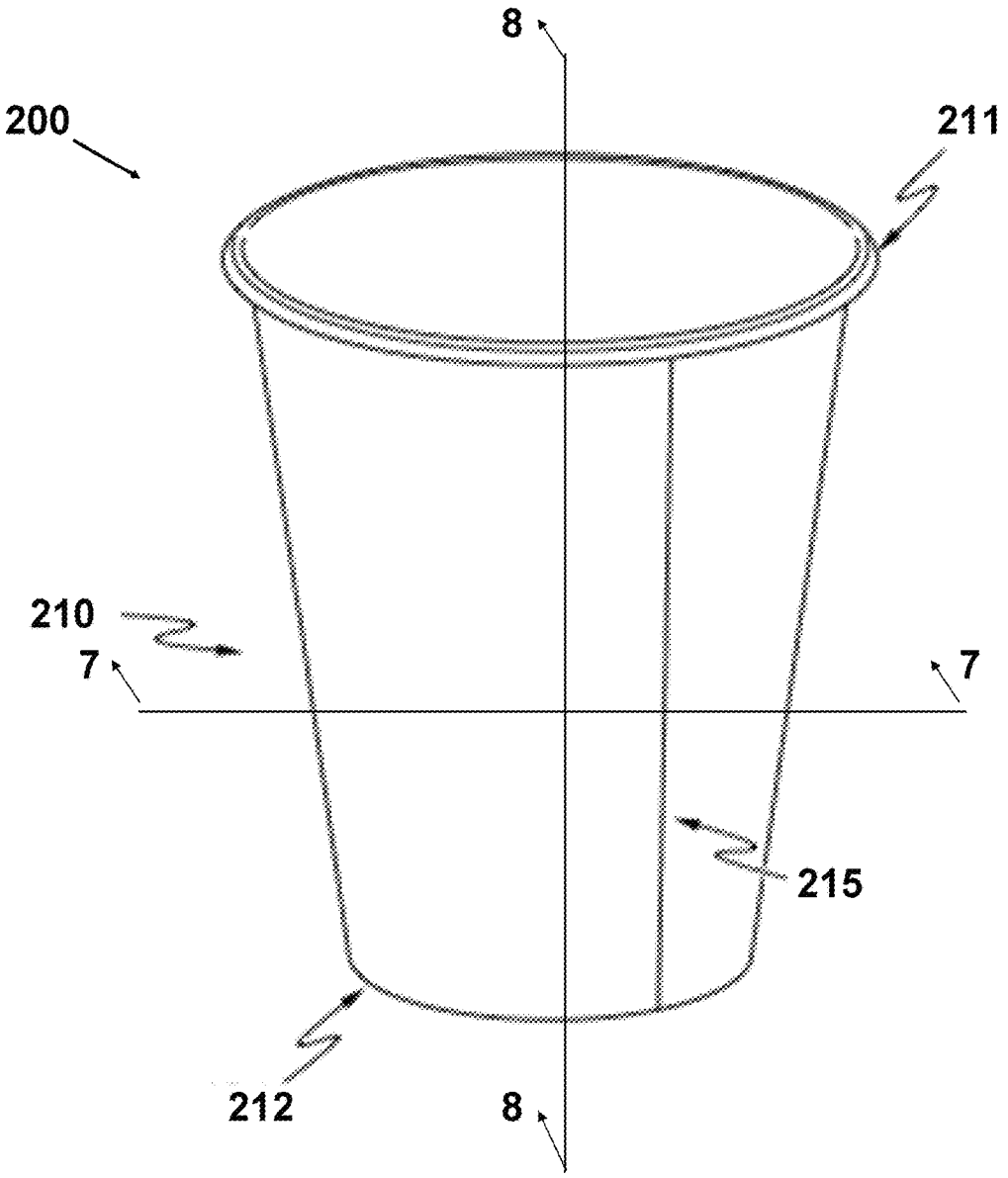
FIG. 6 is a perspective view of a coated paperboard cup for holding cold beverages according to a second embodiment of the present description.

The present description relates to coated paperboard container having a sidewall paperboard substrate and an aqueous barrier coating, with excellent performance and properties. The aqueous barrier coating easily breaks down during repulping and, thus, is more easily repulpable than paperboard cups having a polyethylene extrusion coating. Also, as evidenced in the present application, the coated paperboard container of the present description shows comparable performance and properties as the conventional paperboard cups having the polyethylene extrusion coating. Coated paperboard cups with different coating structures were tested and evaluated for a wide range of properties and performance, and commercial cups with polyethylene coating were used as control for comparison. Details of the testing or evaluation methods are described later.

In an aspect, the coated paperboard container has a repulpability yield of 75% accepts or greater, preferably 80% accepts or greater, more preferably 85% accepts or greater, more preferably 90% accepts or greater.

In another aspect, the coated paperboard container has a sidewall seam bond strength of 30 pounds per inch or greater, preferably 40 pounds per inch or greater, more preferably 50 pounds per inch or greater.

In yet another aspect, the coated paperboard container has a wet rigidity loss of 50% or less, preferably 40% or less, more preferably 30% or less, more preferably 20% or less, even more preferably 10% or less.

In yet another aspect, the coated paperboard container has a 30 minute water Cobb test of 20 $g/m^2$ or less, preferably 10 $g/m^2$ or less, more preferably 5 $g/m^2$ or less.

In yet another aspect, the coated paperboard container has a staining brightness loss of 20% or less, preferably 10% or less, more preferably 5% or less.

In yet another aspect, the coated paperboard container has a blocking rating of 3.5 or less, preferably 3.0 or less, more preferably 2.0 or less.

In yet another aspect, the coated paperboard container has fiber tear of 80% or greater, preferably 90% or greater, when the container seams are separated.

The present description also relates to a coated paperboard container for holding hot beverages having a sidewall that includes a sidewall paperboard substrate and a aqueous barrier coating on the interior surface of the sidewall paperboard substrate, in which a first longitudinal end of the sidewall paperboard substrate is heat sealed, by way of the aqueous barrier coating, to a second longitudinal end of the sidewall paperboard substrate to form a sidewall seam, with excellent performance and properties.

In an aspect, the coated paperboard container for holding hot beverages has a repulpability yield of 75% accepts or greater, preferably 80% accepts or greater, more preferably 85% accepts or greater, more preferably 90% accepts or greater.

In another aspect, the coated paperboard container for holding hot beverages has a sidewall seam bond strength of 30 pounds per inch or greater, preferably 40 pounds per inch or greater, more preferably 50 pounds per inch or greater.

In yet another aspect, the coated paperboard container for holding hot beverages has a wet rigidity loss 50% or less, preferably 40% or less, more preferably 30% or less, more preferably 20% or less, even more preferably 10% or less.

In yet another aspect, the coated paperboard container for holding hot beverages has a 30 minute water Cobb test of 20 $g/m^2$ or less, preferably 10 $g/m^2$ or less, more preferably 5 $g/m^2$ or less.

In yet another aspect, the coated paperboard container for holding hot beverages has a staining brightness loss of 20% or less, preferably 10% or less, more preferably 5% or less.

In yet another aspect, the coated paperboard container for holding hot beverages has a blocking rating of 3.5 or less, preferably 3.0 or less, more preferably 2.0 or less.

In yet another aspect, the coated paperboard container for holding hot beverages has fiber tear of 80% or greater, preferably 90% or greater, when the container seams are separated.

In an aspect, the coated paperboard container for holding hot beverages further includes a bottom wall that includes a bottom stock paperboard substrate and a aqueous barrier coating on the interior surface of the bottom stock paperboard substrate, in which a circumferential portion of the bottom stock paperboard substrate is heat sealed, by way at least one of the aqueous barrier coating of the sidewall and the aqueous barrier coating of the bottom wall, to a lower end of the sidewall paperboard substrate.

In another aspect, the lower end of the sidewall paperboard substrate is folded towards the interior of the coated paperboard container to form a circumferential recess. The circumferential edge of the bottom stock paperboard substrate is folded towards an exterior surface to form a circumferential lip. The circumferential lip of the bottom wall is disposed in the circumferential recess of the sidewall.

In yet another aspect, a non-barrier coating is on the exterior surface of the bottom stock paperboard substrate.

In yet another aspect, another aqueous barrier coating is on the exterior surface of the bottom stock paperboard substrate.

In yet another aspect, a non-barrier coating is on the another aqueous barrier coating.

The present description also relates to a coated paperboard container for holding cold beverages having a sidewall that includes a sidewall paperboard substrate, a first aqueous barrier coating on an interior surface of the sidewall paperboard substrate, and a second aqueous barrier coating on an exterior surface of the sidewall paperboard substrate, in which a first longitudinal end of the sidewall paperboard substrate is heat sealed, by way of at least one of the first aqueous barrier coating and the second aqueous barrier coating, to a second longitudinal end of the sidewall paperboard substrate to form a sidewall seam, with excellent performance and properties.

In an aspect, the coated paperboard container for holding cold beverages has a repulpability yield of 75% accepts or greater, preferably 80% accepts or greater, more preferably 85% accepts or greater, more preferably 90% accepts or greater.

In another aspect, the coated paperboard container for holding cold beverages has a sidewall seam bond strength of 30 pounds per inch or greater, preferably 40 pounds per inch or greater, more preferably 50 pounds per inch or greater.

In yet another aspect, the coated paperboard container for holding cold beverages has a wet rigidity loss of 50% or less, preferably 40% or less, more preferably 30% or less, more preferably 20% or less, even more preferably 10% or less.

In yet another aspect, the coated paperboard container for holding cold beverages has a 30 minute water Cobb test of 20 g/m$^2$ or less, preferably 10 g/m$^2$ or less, more preferably 5 g/m$^2$ or less.

In yet another aspect, the coated paperboard container for holding cold beverages has a staining brightness loss of 20% or less, preferably 10% or less, more preferably 5% or less.

In yet another aspect, the coated paperboard container for holding cold beverages has a blocking rating of 3.5 or less, preferably 3.0 or less, more preferably 2.0 or less.

In yet another aspect, the coated paperboard container for holding cold beverages has fiber tear of 80% or greater, preferably 90% or greater, when the container seams are separated.

In an aspect, the coated paperboard container for holding cold beverages includes a non-barrier coating on the second aqueous barrier coating on the exterior surface of the sidewall paperboard substrate.

In an aspect, the coated paperboard container for holding cold beverages has a bottom wall that includes a bottom stock paperboard substrate, a first aqueous barrier coating on the interior surface of the bottom stock paperboard substrate, and a second aqueous barrier coating on an exterior surface of the bottom stock paperboard substrate. A circumferential portion of the bottom stock paperboard substrate is heat sealed, by way at least one of the first aqueous barrier coating of the sidewall, the second aqueous barrier coating of the sidewall, the first aqueous barrier coating of the bottom wall, and the second aqueous barrier coating of the bottom wall, to a lower end of the sidewall paperboard substrate.

In another aspect, the lower end of the sidewall paperboard substrate is folded towards the interior of the coated paperboard container to form a circumferential recess, the circumferential edge of the bottom stock paperboard substrate is folded towards the exterior surface to form a circumferential lip, and the circumferential lip of the bottom wall is disposed in the circumferential recess of the sidewall.

In another aspect, the coated paperboard container for holding cold beverages includes a non-barrier coating on the second aqueous barrier coating on the exterior surface of the bottom stock paperboard substrate.

Additional aspects of the present description are described below.

The paperboard substrates may include any web of fibrous material that is capable of coating at least one aqueous barrier coating thereon. The paperboard substrates may contain chemical or mechanical pulp and may be bleached or unbleached. Exemplary paperboard substrates may include a coated natural kraft board, a solid beached sulfate board, a solid unbleached sulfate board, a coated recycled board, a coated white lined chipboard, or a folding boxboard.

The thickness of the paperboard substrates may depend on various factors, such as the density of the paperboard substrate. Exemplary paperboard substrates may have a caliper thickness in a range of 6 points to 36 points. In one expression, the paperboard substrates may have a caliper thickness in a range of 7 points to 30 points. In another expression, the paperboard substrates may have a caliper thickness in a range of 14 points to 20 points. In yet another expression, the paperboard substrates may have a caliper thickness in a range of 16 points to 18 points. As used herein, 1 point equals 0.001 inches, which equals 25.4 micrometers (μm).

The weight of the paperboard substrates may depend on various factors. Exemplary paperboard substrates may have a basis weight ranging from 60 to 350 pounds per 3,000 square feet. In one expression, the paperboard substrates may have a basis weight in a range of 100 to 150 pounds per 3,000 square feet. In another expression, the paperboard substrates may have a basis weight in a range of 150 to 180 pounds per 3,000 square feet. In yet another expression, the paperboard substrates may have a basis weight in a range of 180 to 220 pounds per 3,000 square feet.

The aqueous barrier coating may be applied using any suitable method, such as one or more coaters either on a paper machine or on an off-machine coater line such that the aqueous barrier coating forms the exposed, outermost surface of the paperboard substrate. The aqueous barrier coating is heat-sealable such that, when heated, the aqueous barrier coating provides an adhesion to other regions of product with which it contacts.

The aqueous barrier coating may be applied to the paperboard substrates at various coat weights. In one expression, the aqueous barrier coatings may be applied at a coat weight of about 2 to 12 pounds per 3,000 square feet. In another expression, the aqueous barrier coatings may be applied at a coat weight of about 4 to 11 pounds per 3,000 square feet.

The aqueous barrier coating may include a binder and a pigment. In one expression, the ratio of the binder to the pigment can be at least about 1:2 by weight. In another expression, the ratio of the binder to the pigment can be about 1:2 to about 9:1 by weight. In yet another expression, the ratio of the binder to the pigment can be about 1:1 to about 4:1 by weight. In yet another expression, the ratio of the binder to the pigment can be at least about 1:1 by weight.

The binder of the aqueous barrier coating is an aqueous binder. Aqueous binders may include styrene-acrylate (SA). In an example, the binder may "consist essentially of" styrene-acrylate (SA). In another example, the binder may "consist of" styrene-acrylate (SA). In yet another example, the binder may be a mixture of binders that includes styrene-acrylate (SA). Other aqueous binders are also contemplated, such as styrene-butadiene rubber (SBR), ethylene acrylic acid (EAA), polyvinyl acetate (PVAC), polyester dispersion, and combinations thereof.

In one non-limiting aspect, the aqueous binder may have a glass transition temperature (when dried) of 20° C. or higher. In another non-limiting aspect, the aqueous binder may have a glass transition temperature (when dried) of 23° C. or higher. In yet another non-limiting aspect, the aqueous binder may have a glass transition temperature (when dried) of 25° C. or higher. In yet another non-limiting aspect, the aqueous binder may have a glass transition temperature (when dried) of 28° C. or higher. In yet another non-limiting aspect, the aqueous binder may have a glass transition temperature (when dried) of 30° C. or higher. In yet another non-limiting aspect, the aqueous binder may have a glass transition temperature (when dried) of 35° C. or higher. In one expression, the aqueous binder may have a glass transition temperature (when dried) in a range of 20° C. to 60° C. In another expression, the aqueous binder may have a glass transition temperature (when dried) in a range of 25° C. to 45° C.

Specific non-limiting examples of suitable binders include: ACRONAL® S 728 (23 Tg, ° C.), BASF Corporation; CARTASEAL® SCR (30 Tg, ° C.) (referred hereafter as "SA-2"), Achroma; RHOPLEX™ C-360 (32 Tg, ° C.), The Dow Chemical Corporation, and ACRONAL® S 866 (39 Tg, ° C.), BASF Corporation.

The pigment of the aqueous barrier coating may have a controlled particle size distribution. In one expression, the pigment of the aqueous barrier coating may be comprised of relatively fine powders such at least 60 percent (by weight) of the pigment is comprised of particles having a particle size of less than 2 microns. In another expression, at least 70 percent (by weight) of the pigment is comprised of particles having a particle size of less than 2 microns. In yet another expression, at least 80 percent (by weight) of the pigment is comprised of particles having a particle size of less than 2 microns. In yet another expression, at least 90 percent (by weight) of the pigment is comprised of particles having a particle size of less than 2 microns. In yet another expression, at least 95 percent (by weight) of the pigment is comprised of particles having a particle size of less than 2 microns.

In one aspect, the pigment of the aqueous barrier coating may include a clay pigment. In an example, the clay pigment may include kaolin clay, such as a fine kaolin clay. In another example, the clay pigment may include a platy clay, such as a high aspect ratio platy clay (e.g., aspect ratio of at least 40:1).

In another aspect, the pigment of the aqueous barrier coating may include a calcium carbonate ($CaCO_3$) pigment. In an example, the calcium carbonate pigment can be a coarse ground calcium carbonate with a particle size distribution wherein about 60 percent of the particles are less than 2 microns. In another example, the calcium carbonate pigment can be a fine ground calcium carbonate with a particle size distribution wherein about 90 percent of the particles are less than 2 microns. In yet another example, the calcium carbonate pigment can be a fine ground calcium carbonate with a mean particle size of about 0.4 microns.

The pigment may be a pigment blend that includes both clay pigment and calcium carbonate pigment. In one expression, the pigment blend may include one or more of the clay pigment aspects described above. In another expression, the calcium carbonate pigment may include one more of the calcium carbonate aspect described above.

The pigment of the aqueous barrier coating may be (or may include) various other materials. Other pigments, such as plastic pigments, titanium dioxide pigments, talc pigment and the like, may be used.

Specific non-limiting examples of suitable pigments include: HYDRAFINE® 90W, No. 1 ultrafine kaolin clay, KaMin LLC of Macon, Ga. (referred hereafter as "CL-1"); BARRISURF® HX, platy clay with high aspect ratio, IMERYS Kaolin, Ga. (referred hereafter as "CL-2"); XP 6170™, platy clay with high aspect ratio, IMERYS Kaolin, Ga. (referred hereafter as "CL-3"); HYDROCARB® 60, coarse ground calcium carbonate (particle size 60%<2 micron), Omya AG of Oftringen, Switzerland (referred hereafter as "CC-1"); and ROPAQUE™ AF-1352, styrene acrylic polymeric pigment (1.3 micron particles size, 53% void volume), The Dow Chemical Company (referred hereafter as "HSP-1").

Various techniques can be used to coat the paperboard substrates. In one implementation, an aqueous barrier coating composition is prepared by mixing the selected aqueous binder with a pigment. The aqueous barrier coating composition is then applied on at least one side of the paperboard substrate.

Optionally, a base coating can be applied before the aqueous barrier coating composition is applied. The base coating may be applied by a suitable method such as one or more coaters either on the paper machine or on the off-machine coater line. The base coating may include similar ingredients as the aqueous barrier coating layer, namely a binder and a pigment. However, the ratios may be different, namely, a ratio of the binder to the pigment in the base coating may be about 25:100 to about 45:100 by weight.

Non-barrier coatings may additionally be provided to the paperboard substrate, such as to allow for printing of text or graphics. The non-barrier coating may be aqueous non-barrier coatings that may include similar ingredients as the aqueous barrier coating layer, namely a binder and a pigment. Specific non-limiting examples of suitable binders include: ACRONAL® S504 (4 Tg, ° C.), BASF Corporation; RHOPLEX® C-340 (8 Tg, ° C.) (referred hereafter as "SA-1"), The Dow Chemical Corporation; and ACRONAL® 4377 X (11 Tg, ° C.), BASF Corporation. Specific non-limiting examples of suitable pigments include: HYDRAFINE 90W, kaolin clay No. 1 ultrafine clay, KaMin LLC of Macron, Ga. (referred hereafter as "CL-1"); HYDROCARB® 60, coarse ground calcium carbonate (particle size 60%<2 micron), Omya AG of Oftringen, Switzerland (referred hereafter as "CC-1"); and HYDROCARB® 90, fine ground calcium carbonate (particle size 90%<2 micron), Omya AG of Oftringen, Switzerland (referred hereafter as "CC-2")

FIGS. 1 to 3, 4A, 4B, 5A, and 5B illustrate an exemplary coated paperboard cup 100 for holding hot beverages according to a first embodiment of the present description. The coated paperboard cup 100 includes a sidewall 110 and a bottom wall 120. The sidewall 110 includes a sidewall paperboard substrate 130 and a first aqueous barrier coating 135 disposed thereon, and the bottom wall 120 includes a bottom stock paperboard substrate 140 and a second aqueous barrier coating 145 disposed thereon.

The sidewall paperboard substrate 130 has an interior surface 131 facing an interior of the coated paperboard cup 100, an exterior surface 132 facing an exterior of the coated paperboard cup 100, an upper end 111, a lower end 112, a first longitudinal end 114, and a second longitudinal end 115, wherein the lower end 112 of the sidewall paperboard substrate 110 is folded towards the interior of coated paperboard cup 100 to form a circumferential recess 113.

The first aqueous barrier coating 135 is disposed on the interior surface 131 of the sidewall paperboard substrate 130. At the first longitudinal end 114 of the sidewall paperboard substrate 110, the first aqueous barrier coating 135 is heat sealed to the first aqueous barrier coating 135 at the second longitudinal end 115 of the sidewall paperboard substrate 110 to form a sidewall seam 116.

The bottom stock paperboard substrate 140 has an interior surface 141 facing an interior of the coated paperboard cup 100 and an exterior surface 142 facing an exterior of the coated paperboard cup 100, A circumferential edge of the bottom stock paperboard substrate 110 is folded towards the exterior surface 142 to form a circumferential lip 121.

The second aqueous barrier coating 145 is disposed on the interior surface 141 of the bottom stock paperboard substrate 140. The second aqueous barrier coating 145 at the circumferential lip 121 is heat sealed to the first aqueous barrier coating 135 at the lower end 112 of the sidewall paperboard substrate 110.

In an aspect, the coated paperboard container for holding hot beverages according to the first embodiment of the present description has a repulpability yield of 75% accepts or greater, preferably 80% accepts or greater, more preferably 85% accepts or greater, more preferably 90% accepts or greater.

In another aspect, the coated paperboard container for holding hot beverages according to the first embodiment of the present description has a sidewall seam bond strength of 30 pounds per inch or greater, preferably 40 pounds per inch or greater, more preferably 50 pounds per inch or greater.

In yet another aspect, the coated paperboard container for holding hot beverages according to the first embodiment of the present description has a wet rigidity loss of 50% or less, preferably 40% or less, more preferably 30% or less, more preferably 20% or less, even more preferably 10% or less.

In yet another aspect, the coated paperboard container for holding hot beverages according to the first embodiment of the present description has a 30 minute water Cobb test of 20 g/m$^2$ or less, preferably 10 g/m$^2$ or less, more preferably 5 g/m$^2$ or less.

In yet another aspect, the coated paperboard container for holding hot beverages according to the first embodiment of the present description has a staining brightness loss of 20% or less, preferably 10% or less, more preferably 5% or less.

In yet another aspect, the coated paperboard container for holding hot beverages according to the first embodiment of the present description has a blocking rating of 3.5 or less, preferably 3.0 or less, more preferably 2.0 or less.

In yet another aspect, the coated paperboard container for holding hot beverages according to the first embodiment of the present description has fiber tear of 80% or greater, preferably 90% or greater, when the container seams are separated.

Although not shown, the coated paperboard container for holding hot beverages according to the first embodiment of the present description may include a non-barrier coating (not shown) on the second aqueous barrier coating on the exterior surface of the bottom stock paperboard substrate.

Figure 7A:
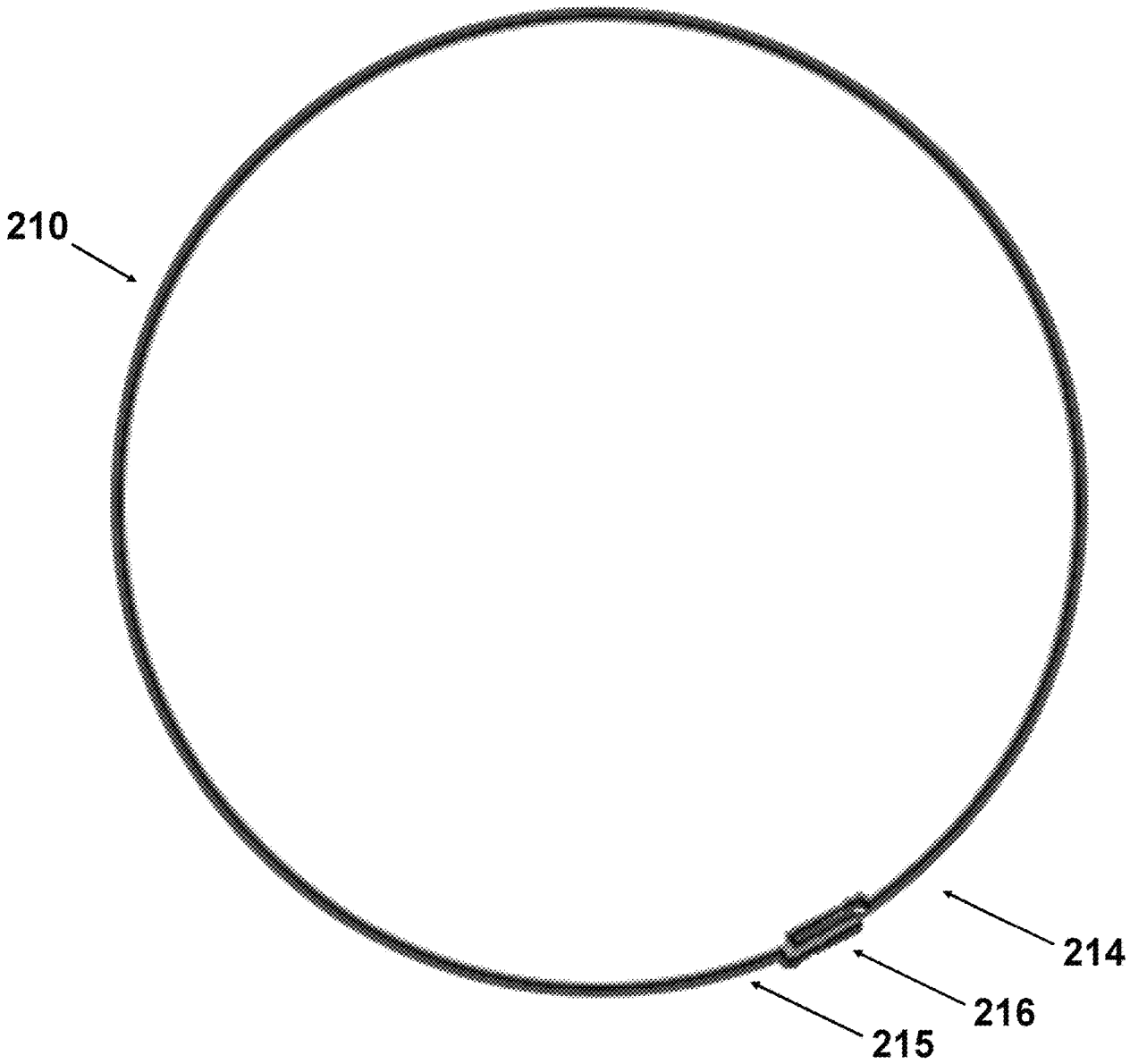
FIG. 7A is a horizontal cross-sectional view of the coated paperboard cup of FIG. 6 along plane 7-7 of FIG. 6.
Figure 7B:
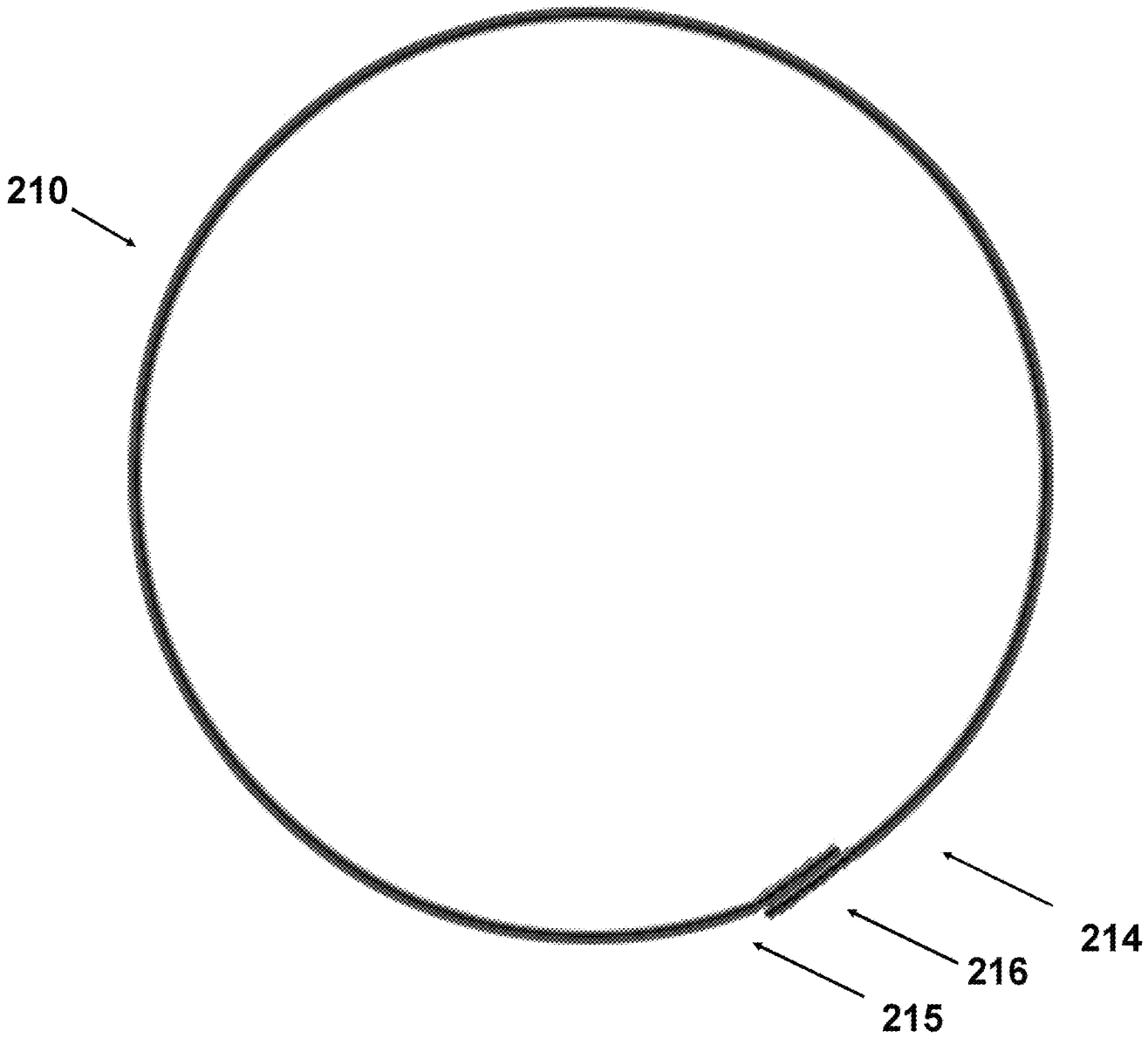
FIG. 7B is a horizontal cross-sectional view of an exemplary variation of the coated paperboard cup as shown in FIG. 7A.
Figure 8:
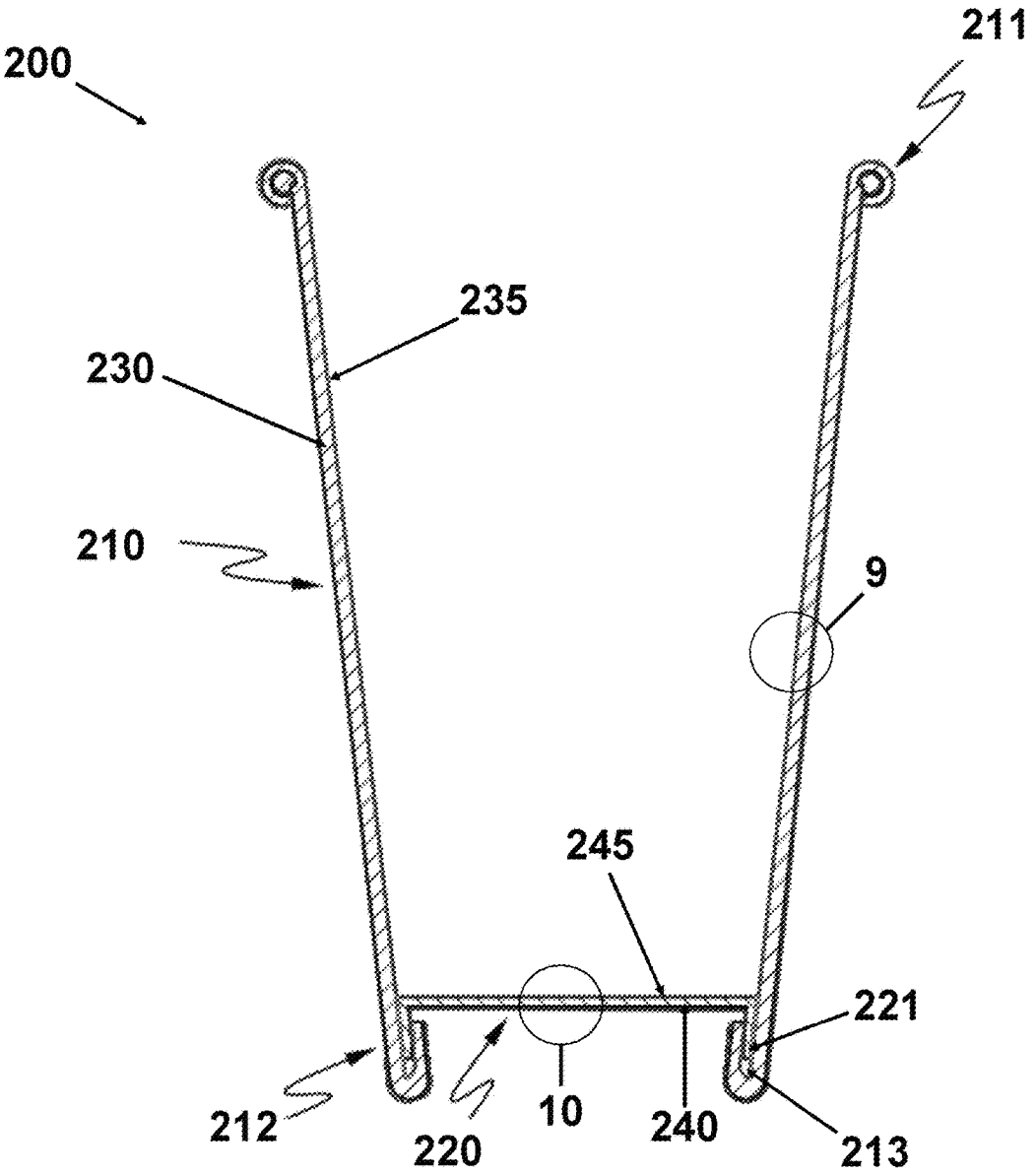
FIG. 8 is a vertical cross-sectional view of the coated paperboard cup of FIG. 6 along plane 8-8 of FIG. 6.
Figure 10A:
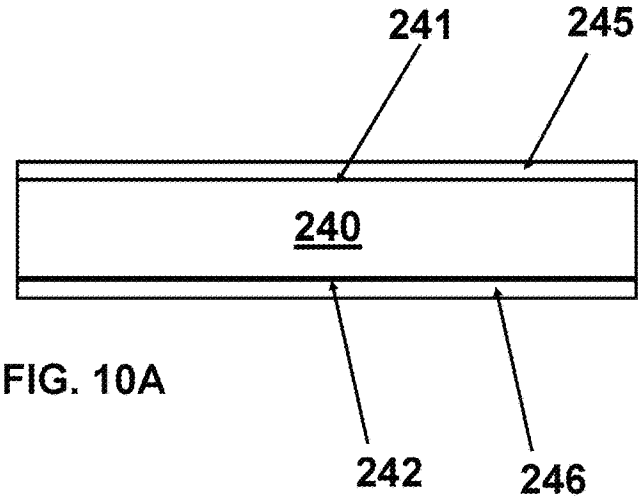
FIG. 10A is a zoomed-in cross-sectional view of the coated paperboard cup at portion "10" of FIG. 8.
Figure 10B:
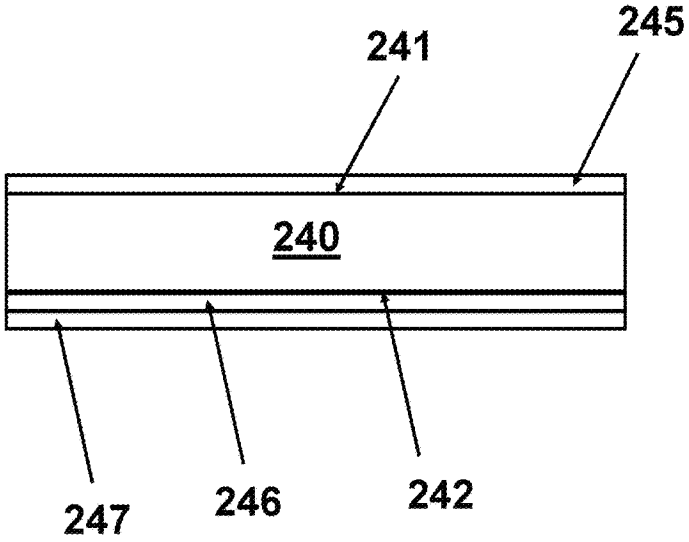
FIG. 10B is a zoomed-in cross-sectional view of an exemplary variation of the coated paperboard cup as shown in FIG. 10A.
Figure 9A:
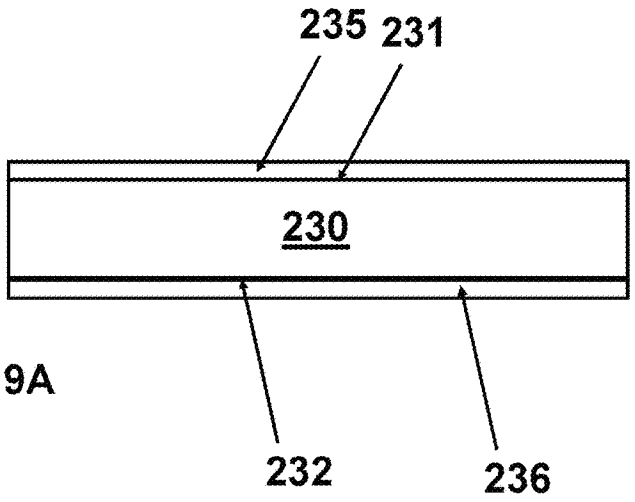
FIG. 9A is a zoomed-in cross-sectional view of the coated paperboard cup at portion "9" of FIG. 8.
Figure 9B:
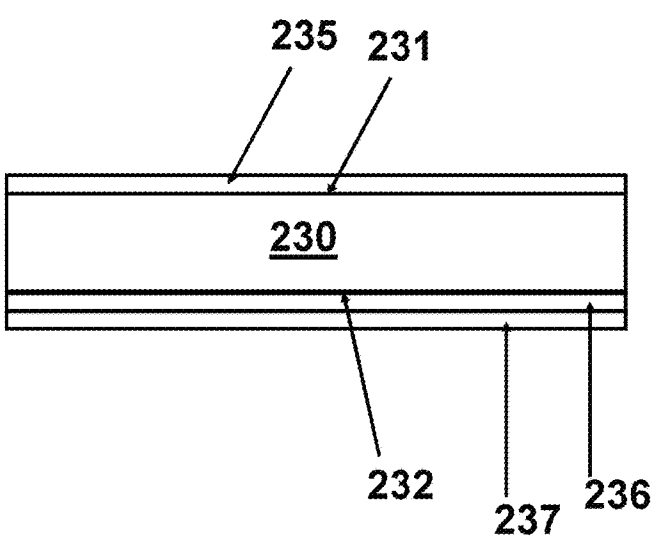
FIG. 9B is a zoomed-in cross-sectional view of an exemplary variation of the coated paperboard cup as shown in FIG. 9A.

FIGS. 6, 7A, 7B, 8, 9A, 9B, 10A, and 10B illustrate an exemplary coated paperboard cup 200 for holding cold beverages according to a second embodiment of the present description. The coated paperboard cup 200 includes a sidewall 210 and a bottom wall 220. The sidewall 210 includes a sidewall paperboard substrate 230, and a first aqueous barrier coating 235 and a second aqueous barrier coating 236 disposed thereon, and the bottom wall 220 includes a bottom stock paperboard substrate 240 and a third aqueous barrier coating 245 and a fourth aqueous barrier coating 246 disposed thereon. Optionally, as shown in FIGS. 9B and 10B, a first non-barrier coating 237 is disposed on the second aqueous barrier coating 236, and a second non-barrier coating 247 is disposed on the fourth aqueous barrier coating 246.

The sidewall paperboard substrate 230 has an interior surface 231 facing an interior of the coated paperboard cup 200, an exterior surface 232 facing an exterior of the coated paperboard cup 200, an upper end 211, a lower end 212, a first longitudinal end 214, and a second longitudinal end 215, wherein the lower end 212 of the sidewall paperboard substrate 210 is folded towards the interior of coated paperboard cup 200 to form a circumferential recess 213.

The first aqueous barrier coating 235 is disposed on the interior surface 231 of the sidewall paperboard substrate 230, and the second aqueous barrier coating 236 is disposed on the exterior surface 232 of the sidewall paperboard substrate 230. As shown in FIG. 7A, at the first longitudinal end 214 of the sidewall paperboard substrate 210, the first aqueous barrier coating 135 is heat sealed to the first aqueous barrier coating 235 at the second longitudinal end 215 of the sidewall paperboard substrate 210 to form a sidewall seam 216. Alternatively, as shown in FIG. 7B, at the first longitudinal end 214 of the sidewall paperboard substrate 210, the first aqueous barrier coating 135 may be heat sealed to the second aqueous barrier coating 236 at the second longitudinal end 215 of the sidewall paperboard substrate 210 to form a sidewall seam 216.

The bottom stock paperboard substrate 240 has an interior surface 241 facing an interior of the coated paperboard cup 200 and an exterior surface 242 facing an exterior of the coated paperboard cup 200, A circumferential edge of the bottom stock paperboard substrate 210 is folded towards the exterior surface 242 to form a circumferential lip 221.

The third aqueous barrier coating 245 is disposed on the interior surface 241 of the bottom stock paperboard substrate 240, and the fourth aqueous barrier coating 246 is disposed on the exterior surface 242 of the bottom stock paperboard substrate 240. As shown in FIG. 8, the first aqueous barrier coating 245 at the circumferential lip 221 is heat sealed to the third aqueous barrier coating 235 at the lower end 212 of the sidewall paperboard substrate 210.

In an aspect, the coated paperboard container for holding cold beverages according to the second embodiment of the present description has a repulpability yield of 75% accepts or greater, preferably 80% accepts or greater, more preferably 85% accepts or greater, more preferably 90% accepts or greater.

In another aspect, the coated paperboard container for holding cold beverages according to the second embodiment of the present description has a sidewall seam bond strength of 30 pounds per inch or greater, preferably 40 pounds per inch or greater, more preferably 50 pounds per inch or greater.

In yet another aspect, the coated paperboard container for holding cold beverages according to the second embodiment of the present description has a wet rigidity loss of 50% or less, preferably 40% or less, more preferably 30% or less, more preferably 20% or less, even more preferably 10% or less.

In yet another aspect, the coated paperboard container for holding cold beverages according to the second embodiment of the present description has a 30 minute water Cobb test of 20 g/m$^2$ or less, preferably 10 g/m$^2$ or less, more preferably 5 g/m$^2$ or less.

In yet another aspect, the coated paperboard container for holding cold beverages according to the second embodiment of the present description has a staining brightness loss of 20% or less, preferably 10% or less, more preferably 5% or less.

In yet another aspect, the coated paperboard container for holding cold beverages according to the second embodiment of the present description has a blocking rating of 3.5 or less, preferably 3.0 or less, more preferably 2.0 or less.

In yet another aspect, the coated paperboard container for holding cold beverages according to the second embodiment of the present description has fiber tear of 80% or greater, preferably 90% or greater, when the container seams are separated.

In an aspect, the coated paperboard container for holding cold beverages according to the second embodiment of the present description may include a non-barrier coating on the second aqueous barrier coating on the exterior surface of the sidewall paperboard substrate.

In another aspect, the coated paperboard container for holding cold beverages according to the second embodiment of the present description may include a non-barrier coating on the second aqueous barrier coating on the exterior surface of the bottom stock paperboard substrate.

Repulpability yield was determined using an AMC Maelstom repulper. 110 grams of coated paperboard, cut into 1-inch by 1-inch squares, was added to the repulper containing 2895 grams of water (pH of 6.5±0.5, 50° C.), soaked for 15 minutes, and then repulped for 30 minutes. 300 mL of the repulped slurry was then screened through a vibrating flat screen (0.006-inch slot size). Rejects (caught by the screen) and fiber accepts were collected, dried, and weighed. The percentage of accepts was calculated based on the weights of accepts and rejects, with 100% being complete repulpability.

Sidewall seam bond strength was determined by conditioning samples in accordance with TAPPI T402. Samples were then cut to linch wide strips (perpendicular to the side wall seam) using a precision cutter. Bond strength was measured using an Instron 5965 with a 5 kN load cell according to TAPPI standard T494. Samples were clamped in the Instron using serrated clamps set to a 4-inch gauge length with the side wall seam between the two clamps and print side facing the operator. Rate of separation of the clamps was set to 1 inch per minute and max load was recorded and reported as the bond strength of the side wall seam.

Figure 11:
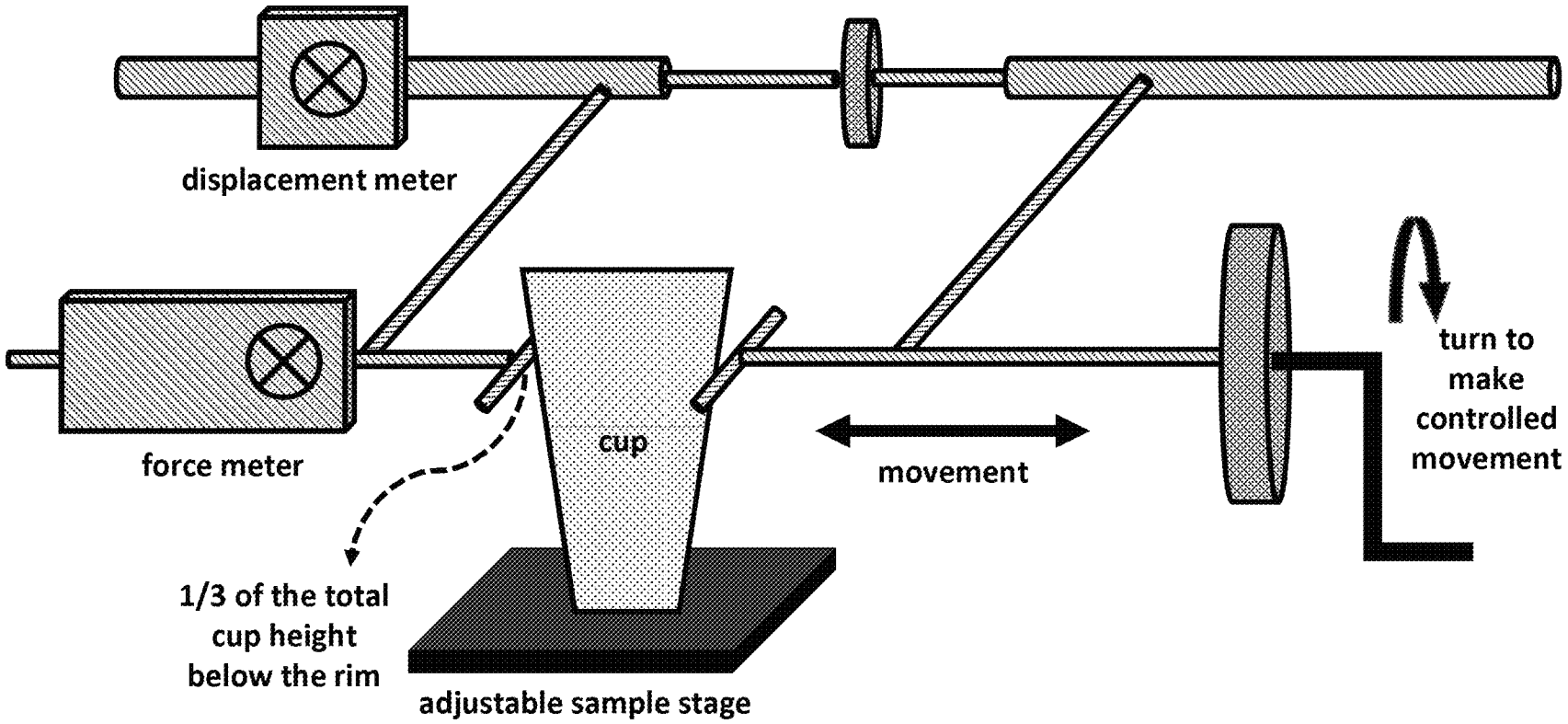
FIG. 11 is a representation of a "Perseco" Cup Rigidity Tester used for evaluating wet rigidity and dry rigidity of paperboard cups of the present application.

Wet rigidity and dry rigidity was determined using a "Perseco" Cup Rigidity Tester, as shown in FIG. 11, with two T-bar contact fittings.

For dry rigidity, the dry tested cup was placed on an adjustable stage of the Cup Rigidity Tester with side seam facing toward the operator. The height of the stage was adjusted so that the two T-bar contact fittings were positioned on the cup at 90 degrees to the side-seam and ⅓ of total cup height below the top of the curl (lip). The hand wheel was turned to compress the cups 0.25 inch. Peak force in kilograms was measured and recorded. Five samples of each test condition were tested and the average rigidity per 0.25 inch deflection was recorded.

For wet rigidity, hot cup testing was performed by brewing 36 g of STARBUCKS medium house blend coffee with 1100 mL of distilled water in a 12 cup MR. COFFEE maker. The coffee was then poured into a beaker with a magnetic stir bar and the coffee was heated to 90° C. and stirred at 55 rpm. Coffee was then poured into cups to a level 5 mm below the rim of the cup. After a 30-minute hold, the coffee was removed from the cups and rinsed with distilled water. The empty cups were then immediately tested for rigidity according to the same procedure for testing dry rigidity.

For wet rigidity, cold cup testing was performed by mixing 75 g of cherry-flavored KOOL-AID drink mix with 1 L of distilled water until powder was completely dissolved. The KOOL-AID drink was then refrigerated to 7° C. (±0.5° C.) and then poured into cups to a level 5 mm below the rim of the cup. The cups were then transferred to an environmental chamber at 30° C. and 75% relative humidity. After a 30-minute hold, the KOOL-AID drink was removed from the cups, rinsed with distilled water, and condensation was wiped from the outside of the cups. The empty cups were then immediately test for rigidity according to the same procedure for testing dry rigidity.

Wet rigidity loss was determined as a percentage change in rigidity comparing the dry rigidly of the cup to the wet rigidity of the cup.

Water barrier properties were evaluated by 30-minute water Cobb test (TAPPI Standard T441 om-04) in g/m$^2$ per 30 minutes, using 23° C. water. In other words, the Cobb test determines how much water is absorbed after 30 minutes.

Staining brightness loss was determined by measuring brightness of the dry cups and then measuring brightness of the wet cups after the hot cup testing using coffee and cold cup testing using KOOL-AID was described above. The color of the samples was measured as L-a-b color space values using a Technidyne Brightimeter Micro S-5 equipment according to TAPPI standard T524. The brightness of the samples was measured on a Technidyne Brightimeter Micro S-5 according to TAPPI standard T452. Staining brightness loss was determined as a percentage change in brightness comparing the dry cup to the wet cup after treatment in coffee or KOOL-AID.

TABLE 1

| Rating | Description |
|---|---|
| 0 | Samples fall apart without any force applied |
| 1 | Samples have a light tackiness but separate without fiber tear |
| 2 | Samples have a high tackiness but separate without fiber tear |
| 3 | Samples are sticky and up to 25% fiber tear or coat damage (area basis) |
| 4 | Samples have more than 25% fiber tear or coat damage (area basis) |

Figure 12:
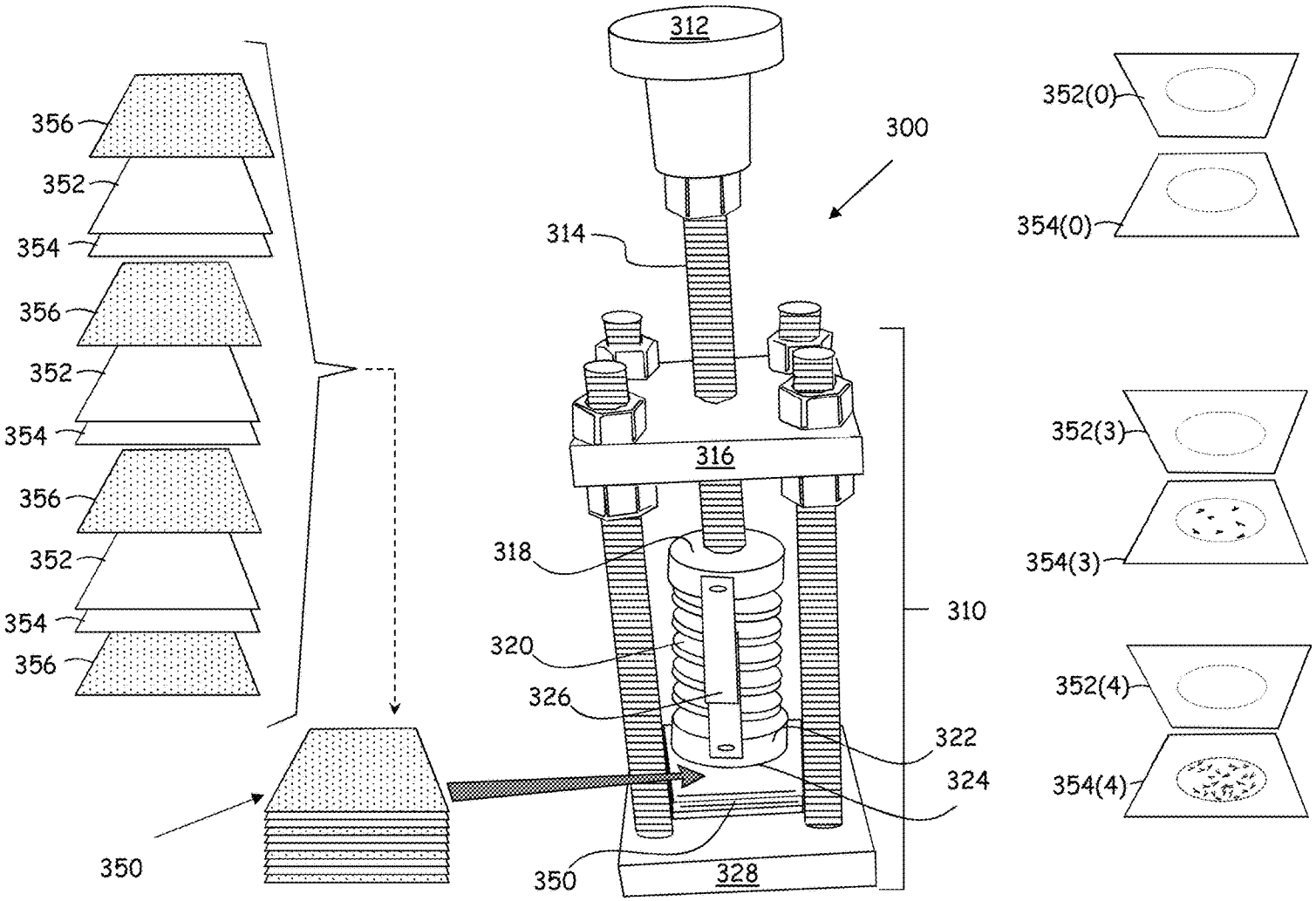
FIG. 12 is a representation of a blocking test for evaluating blocking properties of paperboard cups of the present application.

Table 1 above defines the blocking test rating system. The blocking behavior of the samples was tested by evaluating the adhesion between the interior side of the cup and the exterior side of the cup. A simplified illustration of the blocking test is shown in FIG. 12. The paperboard was cut into 2-inch by 2-inch square samples. Several duplicates were tested for each condition, with each duplicate evaluating the blocking between a pair of samples 352, 354. (For example, if four duplicates were tested, four pairs—eight pieces—would be used.) Each pair was positioned with the interior side of one piece 352 contacting the exterior side of the other piece 354. The pairs were placed into a stack 350 with a spacer 356 between adjacent pairs, the spacer being foil, release paper, or even copy paper. The entire sample stack was placed into the test device 300 illustrated in FIG. 12.

The test device 300 includes a frame 310. An adjustment knob 312 is attached to a screw 314 which is threaded through the frame top 316. The lower end of screw 314 is attached to a plate 318 which bears upon a heavy coil spring 320. The lower end of the spring 320 bears upon a plate 322 whose lower surface 324 has an area of one square inch. A scale 326 enables the user to read the applied force (which is equal to the pressure applied to the stack of samples through the one-square-inch lower surface 324).

The stack 350 of samples is placed between lower surface 324 and the frame bottom 328. The knob 312 is tightened until the scale 326 reads the desired force of 60 lbf (60 psi applied to the samples). The entire device 300 including samples is then placed in an oven at 50° C. for 24 hours. The device 300 is then removed from the test environment and cooled to room temperature. The pressure is then released, and the samples removed from the device.

The samples were evaluated for tackiness and blocking by separating each pair of paperboard sheets. Blocking damage is visible as fiber tear, which if present usually occurs with fibers pulling up from the exterior side of samples 354. If the exterior side was coated, then blocking might also be evinced by damage to the coating on the exterior side.

For example, in as symbolically depicted in FIG. 12, samples 352(0)/354(0) might be representative of a "0" rating (no blocking). The circular shape in the samples indicates an approximate area that was under pressure, for instance about one square inch of the overall sample. Samples 352(3)/354(3) might be representative of a "3" blocking rating, with up to 25% fiber tear in the area that was under pressure, particularly in the uncoated surface of sample 354(3). Samples 352(4)/354(4) might be representative of a "4" blocking rating with more than 25% fiber tear, particularly in the uncoated surface of sample 354(4). The depictions in FIG. 12 are only meant to approximately suggest the percent damage to such test samples, rather than showing a realistic appearance of the samples.

The following tests were conducted showing excellent performance and properties for the coated paperboard containers of the present description.

Table 2 below shows six pigments used in exemplary aqueous coatings of the present description.

TABLE 2

| Name | Pigment | Description |
|---|---|---|
| CL-1 | HYDRAFINE ® 90W (KaMin LLC of Macon, Georgia) | kaolin clay No. 1 ultrafine clay |
| CL-2 | BARRISURF ™ HX (IMERYS Kaolin, Georgia) | platy clay with high aspect ratio |
| CL-3 | XP 6170 ™ (IMERYS Kaolin, Georgia) | platy clay with high aspect ratio |
| CC-1 | HYDROCARB ® 60 (Omya AG of Oftringen, Switzerland) | Coarse ground $CaCO_3$ (particle size 60% < 2 micron) |
| CC-2 | HYDROCARB ® 90 (Omya AG) | fine ground $CaCO_3$ (particle size 90% < 2 micron) |
| HSP-1 | ROPAQUE ™ AF-1353 (The Dow Chemical Company) | styrene acrylic polymeric pigment (1.3 μm particle size, 53% void volume) |

Table 3 below shows two binders used in the exemplary aqueous coatings of the present description.

TABLE 3

| Supplier | Binder Product | Tg, ° C. |
|---|---|---|
| The Dow Chemical Company | RHOPLEX ™ C-340 also known as "SA-1" | 8 |
| Archroma | CARTASEAL ® SCR also known as "SA-2" | 30 |

Table 4 below shows formulations (parts by weight) used in the exemplary aqueous coatings of the present description.

TABLE 4

| | Barrier Coat | | | Non-Barrier Coat | |
|---|---|---|---|---|---|
| Formulation (in Parts) | BC-1 | BC-2 | BC-3 | NBC-1 | NBC-2 |
| CaCO3 (CC-1) | 62.8 | 62.8 | 65 | | 50 |
| CaCO3 (CC-2) | | | | 50 | |
| Clay (CL-1) | | | | 50 | 50 |
| Clay (CL-2) | 31.4 | 31.4 | | | |
| Clay (CL-3) | | | 35 | | |
| Hollow Sphere Pigment (HSP-1) | 5.8 | 5.8 | | | |
| Binder (SA-1) | | | | 25 | 25 |
| Binder (SA-2) | 300 | 200 | 250 | | |

Table 5 below shows characteristics and properties for four exemplary coated sidewall paperboard substrates and two exemplary bottom stock paperboard substrate used in exemplary paperboard containers of the present description. All samples were coated using a blade coater. The sidewall paperboard substrates were solid beached sulfate board having 18 point caliper thickness and 185 pounds/3000 square foot basis weight, and the bottom stock paperboard substrates were solid beached sulfate board having 13 point caliper thickness and 150 pounds/3000 square foot basis weight. The felt side of the sidewall paperboard substrates and bottom stock paperboard substrates corresponds to the interior side of the cup, and the wire side of the sidewall paperboard substrates and bottom stock paperboard substrates corresponds to the exterior side of the cup. The coated paperboard substrates were evaluated for barrier properties by the 30-minute water Cobb test as described above, for blocking properties as described above, and for repulpability yield as described above.

TABLE 5

| Sample ID | SW (Side Wall)-1 | | SW-2 | | SW-3 | | SW-4 | | BS (Bottom Stock)-1 | | BS-2 | |
|---|---|---|---|---|---|---|---|---|---|---|---|---|
| Substrate | 18 pt, 185 lb/3000F2, SBS cupstock | | | | | | | | 13 pt, 150 lb/3000F2, SBS cupstock | | | |
| Surface | Felt Side | Wire Side | Felt Side | Wire Side | Felt Side | Wire Side | Felt Side | Wire Side | Felt Side | Wire Side | Felt Side | Wire Side |
| Barrier coat | BC-1 | BC-2 | BC-3 | BC-3 | BC-3 | | BC-3 | | BC-1 | BC-2 | BC-3 | |
| Barrier coat weight (lb/3000F2) | 9.3 | 10.1 | 9.8 | 10.2 | 9.7 | | 7.4 + 2.5 (2-layer) | | 10.0 | 9.3 | 6.9 + 3.1 (2-layer) | |
| Non-Barrier coat | | NBC-1 | | NBC-1 | | | | | | NBC-1 | | NBC-2 |
| Non-Barrier coat weight (lb/3000F2) | | 2.8 | | 3.2 | | | | | | 2.9 | | 9.6 |
| H2O Cobb (g/m2-30 min) | 4.8 | 13.9 | 4.5 | 14.6 | 5.3 | | 5.3 | | 3.8 | 11.0 | 3.5 | |
| Blocking Rating (50° C./60 psi/24 h) | 2.4 | | 3.3 | | 1.4 | | 2.0 | | 2.5 | | 4.0 | |
| Repulpability Yield (% accepts) | 84.2% | | 83.0% | | 92.0% | | 92.2% | | 80.4% | | 91.4% | |

The sidewall paperboard substrates and bottom stock paperboard substrates were formed into cups. Table 6 below shows characteristics of the exemplary paperboard cups of the present description and also comparative examples made with polyethylene extrusion coated paperboard. The side wall blanks (SW-2 Printed) for CC-3 cups were printed on an OMET 530 Varyflex F1 flexo printing press with Siegwerk pc000200 aqueous ink and Siegwerk OPV1V10167 overprint varnish. A 500 LPI (lines per inch) and 5.0 BCM (billion cubic micron) anilox roll was used for the overprint varnish. These cups were made on a PMC (Paper Machinery Corporation) cup machine, model PMC-1250, at a speed of 150 cups/minute. The fiber tear of the cup seams was evaluated by tearing apart the side-wall and cup-bottom seams by hand, and the fiber tear area was estimated as percentage of the seam area, with a 100% fiber tear meaning excellent heat-sealed seams.

TABLE 6

| | Cup for Cold Beverage | | | | Cup for Hot Beverage | | | |
|---|---|---|---|---|---|---|---|---|
| Samples ID | CC-1 | CC-2 | CC-3 | CC-Comparative | HC-1 | HC-2 | HC-3 | HC-Comparative |
| Side Wall | SW-1 | SW-2 | SW-2 Printed | 18 pt PE-coated 2-side cupstock (Westrock) | SW-3 | SW-3 | SW-4 | 18 pt PE-coated 1-side cupstock (Westrock) |
| Bottom Stock | BS-1 | BS-1 | BS-1 | 13 pt PE-coated 2-side cupstock (Westrock) | BS-1 | BS-2 | BS-2 | 13 pt PE-coated 2-side cupstock (Westrock) |

The cold cups and hot cups listed in Table 6 were tested for repulpability yield, sidewall seam bond strength, wet rigidity loss, and staining brightness loss. Additionally, three commercially produced cups were obtained and tested for comparison.

All the results for the cold cups are listed in the below Tables 7A to 7C. The commercial cold cup used in testing was a 16 oz. commercial cold beverage cup having a PE extrusion coating from Graphic Packing International (listed below as "GP CC Control (PE)").

TABLE 7A

| Cold Cups | | Extruded Coating | 30-m Cobb (inside/outside) | Repulpability Yield | Blocking (50 C./60 psi) | Staining Spots |
|---|---|---|---|---|---|---|
| CC-1 | SW - 18 pt | no | 4.8/13.9 | 84.2% | 2.4 | 1/1 |
| | Bottom - 13 pt | no | 3.8/11.0 | 80.4% | 2.5 | 1/5 |
| CC-2 | SW - 18 pt | no | 4.5/14.6 | 83.0% | 3.3 | 2/1 |
| | Bottom - 13 pt | no | 3.8/11.0 | 80.4% | 2.5 | 0/0 |
| CC-3 | SW - 18 pt | no | 4.5/4.5 | 82.2% | 3.6 | 1/1 |
| | Bottom - 13 pt | no | 3.8/11.0 | 80.4% | 2.5 | 1/0 |
| CC-Comp. | SW - 18 pt P2S | yes | 0/0.3 | 86.8% | 0 | 0/0 |
| | Bottom - 13 pt | yes | 0/0 | 75.4% | 0 | 0/0 |
| GP CC Control | SW - 13.5 pt P2S | yes | | | | |
| | Bottom - 12 pt | yes | | | | |

TABLE 7B

| Cold Cups | | L-a-b Dry | L-a-b Wet | Δ b | Brightness Dry | Brightness Wet |
|---|---|---|---|---|---|---|
| CC-1 | SW - 18 pt | 92.6/−0.02/4.6 | 92.5/0.2/4.6 | 0.00 | 80.5 | 80.2 |
| | Bottom - 13 pt | 92.1/−0.2/4.9 | 92.1/−0.04/5.0 | 0.10 | 79.2 | 79 |
| CC-2 | SW - 18 pt | 92.2/−0.1/4.7 | 92.1/0.1/4.7 | 0.00 | 79.6 | 79.4 |
| | Bottom - 13 pt | 92.1/−0.2/4.9 | 92.1/0.04/4.7 | −0.20 | 79.2 | 79.3 |
| CC-3 | SW - 18 pt | 92.0/−0.3/4.4 | 92.0/0.1/4.4 | 0.00 | 79.7 | 79.6 |
| | Bottom - 13 pt | 92.1/−0.2/4.9 | 92.1/0.1/4.7 | −0.20 | 79.2 | 79.4 |
| CC-Comp. | SW - 18 pt P2S | 90.5/0/4.0 | 92.4/0.6/4.0 | 0.00 | 81 | 81 |
| | Bottom - 13 pt | 92.1/0.3/3.7 | 91.9/0.3/4.1 | 0.40 | 80.7 | 80 |
| GP CC Control | SW - 13.5 pt P2S | | | | | |
| | Bottom - 12 pt | | | | | |

TABLE 7C

| Cold Cups | | % Δ Brightness | Side-Seam Strength (lb/inch) | Fiber Tear | Dry Rigidity (0.25" deflection) | Wet Rigidity (0.25" deflection) | % Δ Rigidity |
|---|---|---|---|---|---|---|---|
| CC-1 | SW - 18 pt | −0.4% | 49.27 | 100% | 0.729 | 0.483 | −33.7% |
| | Bottom - 13 pt | −0.3% | | 100% | | | |
| CC-2 | SW - 18 pt | −0.3% | 49.24 | 100% | 0.781 | 0.485 | −37.9% |
| | Bottom - 13 pt | 0.1% | | 100% | | | |
| CC-3 | SW - 18 pt | −0.1% | 48.85 | 100% | 0.765 | 0.597 | −22.0% |
| | Bottom - 13 pt | 0.3% | | 100% | | | |
| CC-Comp. | SW - 18 pt P2S | 0.0% | 56.38 | 100% | 0.722 | 0.692 | −4.2% |
| | Bottom - 13 pt | −0.9% | | 100% | | | |
| GP CC Control | SW - 13.5 pt P2S | | | 100% | 0.352 | 0.332 | −5.7% |
| | Bottom - 13 pt | | | 100% | | | |

All the results for the hot cups are listed in the below Tables 8A to 8C. The first commercial hot cup used in testing was a 16 oz. commercial hot beverage cup with a PE extrusion coating from Clearwater Paper (listed below as "CW HC-Control"). The second commercial hot cup used in testing was a Kotkamills aqueous coated paperboard cup obtained from Sustainable Packaging Coalition, Advance 2018, Boston, Sep. 26-28, 2018, which is listed below as "HC-Control".

TABLE 8A

| Hot Cups | | Extruded Coating | 30-m Cobb (inside) | Repulpability Yield | Blocking (50 C./60 psi) | Staining Spots |
|---|---|---|---|---|---|---|
| HC-1 | SW - 18 pt | no | 5.3 | 92.0% | 1.4 | 1/1 |
| | Bottom - 13 pt | no | 3.8 | 80.4% | 2.5 | 10/11 |
| HC-2 | SW - 18 pt | no | 5.3 | 92.0% | 1.4 | 0/0 |
| | Bottom - 13 pt | no | 3.5 | 91.4% | 4 | 7/8 |
| HC-3 | SW - 18 pt | no | 5.3 | 92.2% | 2 | 0/0 |
| | Bottom - 13 pt | no | 3.5 | 91.4% | 4 | 8/11 |
| HC-Comp. | SW - 18 pt | yes | 0 | 86.3% | 0 | 2/0 |
| | Bottom 13 pt | yes | 0 | 75.4% | 0 | 0/1 |
| CW HC-Control (PE) | SW - 17 pt | yes | | | | 0/0 |
| | Bottom - 14 pt | yes | | | | 1/0 |
| HC-Control (aqueous) | SW - 14 pt | no | 1.6 | 69.2% | 1 | 2/2 |
| | Bottom - 11 pt | no | | | 0.1 | 7/4 |

TABLE 8B

| Hot Cups | | L-a-b Dry | L-a-b Wet | Δ b | Brightness Dry | Brightness Wet |
|---|---|---|---|---|---|---|
| HC-1 | SW - 18 pt | 92.2/−0.1/4.9 | 88.9/−0.9/12.6 | 7.7 | 79.5 | 64.0 |
| | Bottom - 13 pt | 92.1/−0.2/4.9 | 89.6/−0.9/9.7 | 4.8 | 79.2 | 68.8 |
| HC-2 | SW - 18 pt | 92.2/−0.1/4.9 | 89.0/−0.9/12.0 | 7.1 | 79.5 | 65 |
| | Bottom - 13 pt | 91.8/−0.2/5.0 | 89.4/−0.8/10.0 | 5.0 | 78.6 | 68 |
| HC-3 | SW - 18 pt | 92.8/−0.2/4.7 | 88.3/−0.7/12.8 | 8.1 | 80 | 62.8 |
| | Bottom - 13 pt | 91.8/−0.2/5.0 | 89.4/−0.8/10.1 | 5.1 | 78.6 | 68.1 |
| HC-Comp. | SW - 18 pt | 91.5/−0.5/6.2 | 90.7/−0.5/7.4 | 1.2 | 76.5 | 73.5 |
| | Bottom - 13 pt | 92.1/0.3/3.7 | 91.3/0.1/5.3 | 1.6 | 80.7 | 77.1 |
| CW HC Control (PE) | SW -17 pt | 91.0/0.2/2.1 | 90.3/0.2/3.4 | 1.3 | 80.9 | 77.9 |
| | Bottom - 14 pt | 92.4/0.1/2.0 | 90.9/0.1/3.3 | 1.3 | 83.5 | 78.9 |
| HC-Control (aqueous) | SW - 14 pt | 92.01/0.45/5.55 | 89.6/−0.6/11.8 | 6.3 | 78.04 | 66 |
| | Bottom - 11 pt | 91.46/0.27/5.82 | 89.0/−0.6/9.5 | 3.7 | 76.78 | 67.8 |

TABLE 8C

| Hot Cups | | % Δ Brightness | Side-Seam Strength (lbs/inch) | Fiber Tear | Dry Rigidity (0.25" deflection) | Wet Rigidity (0.25" deflection)-No Rich's | % Δ Rigidity |
|---|---|---|---|---|---|---|---|
| HC-1 | SW - 18 pt | −19.5% | 49.65 | 100 | 0.662 | 0.621 | −6.2% |
| | Bottom - 13 pt | −0.1% | | 100 | | | |
| HC-2 | SW - 18 pt | −18.2% | 48.69 | 100 | 0.692 | 0.636 | −8.1% |
| | Bottom - 13 pt | −0.5% | | 100 | | | |
| HC-3 | SW - 18 pt | −21.5% | 50.33 | 100 | 0.666 | 0.607 | −8.9% |
| | Bottom - 13 pt | −0.4% | | 100 | | | |
| HC-Comp. | SW - 18 pt | −3.9% | 44.17 | 100 | 0.573 | 0.643 | 12.2% |
| | Bottom - 13 pt | −4.5% | | 100 | | | |
| CW HC Control (PE) | SW - 17 pt | −3.7% | 50.24 | 100 | 0.540 | 0.552 | 2.2% |
| | Bottom - 14 pt | −5.5% | | 100 | | | |
| HC-Control (aqueous) | SW - 14 pt | −15.4% | 41.57 | 100 | 0.405 | 0.304 | −25.0% |
| | Bottom - 11 pt | −11.7% | | 100 | | | |

The above experimental results show that the coated paperboard containers of the present description have comparable performance and properties to the conventional paperboard cups having the polyethylene extrusion coating. Accordingly, the coated paperboard containers of the present description achieve improved repulpability due to the aqueous barrier coating easily breaking down during repulping without sacrificing performance and properties.

Although various embodiments of the disclosed coated paperboard containers have been shown and described, modifications may occur to those skilled in the art upon reading the specification. The present application includes such modifications and is limited only by the scope of the claims.

What is claimed is:

1. A coated paperboard container for holding beverages, comprising:

a paperboard substrate, the paperboard substrate defining a container wall having an interior surface facing an interior of said container and an exterior surface facing an exterior of said container;

a heat sealable aqueous barrier coating on the interior surface of the paperboard substrate, wherein the heat sealable aqueous barrier coating consists essentially of binder and pigment; and at least one of another aqueous barrier coating and a non-barrier coating on the exterior surface of the paperboard substrate, wherein the coated paperboard container has a repulpability yield of 75% accepts or greater and a wet rigidity loss of 50% or less.

2. The coated paperboard container of claim 1, wherein the coated paperboard container has a repulpability yield of 80% accepts or greater.

3. The coated paperboard container of claim 1, wherein the coated paperboard container has a repulpability yield of 85% accepts or greater.

4. The coated paperboard container of claim 1, wherein the coated paperboard container has a repulpability yield of 90% accepts or greater.

5. The coated paperboard container of claim 1, wherein the coated paperboard container has a sidewall seam bond strength of 30 pounds per inch or greater.

6. The coated paperboard container of claim 1, wherein the coated paperboard container has a sidewall seam bond strength of 40 pounds per inch or greater.

7. The coated paperboard container of claim 1, wherein the coated paperboard container has a sidewall seam bond strength of 50 pounds per inch or greater.

8. The coated paperboard container of claim 1, wherein the coated paperboard container has a wet rigidity loss of 40% or less.

9. The coated paperboard container of claim 1, wherein the coated paperboard container has a wet rigidity loss of 30% or less.

10. The coated paperboard container of claim 1, wherein the coated paperboard container has a wet rigidity loss of 20% or less.

11. The coated paperboard container of claim 1, wherein the coated paperboard container has a wet rigidity loss of 10% or less.

12. The coated paperboard container of claim 1, wherein the coated paperboard container has a 30 minute water Cobb test of 20 $g/m^2$ or less.

13. The coated paperboard container of claim 1, wherein the coated paperboard container has a 30 minute water Cobb test of 10 $g/m^2$ or less.

14. The coated paperboard container of claim 1, wherein the coated paperboard container has a 30 minute water Cobb test of 5 $g/m^2$ or less.

15. The coated paperboard container of claim 1, wherein the coated paperboard container has a staining brightness loss of 20% or less.

16. The coated paperboard container of claim 1, wherein the coated paperboard container has a staining brightness loss of 10% or less.

17. The coated paperboard container of claim 1, wherein the coated paperboard container has a staining brightness loss of 5% or less.

18. The coated paperboard container of claim 1, wherein the coated paperboard container has a blocking rating of 3.5 or less.

19. The coated paperboard container of claim 1, wherein the coated paperboard container has a blocking rating of 3.0 or less.

20. The coated paperboard container of claim 1, wherein the coated paperboard container has a blocking rating of 2.0 or less.

21. The coated paperboard container of claim 1, wherein the coated paperboard container has a fiber tear of 80% or greater when the container seams are separated.

22. The coated paperboard container of claim 1, wherein the coated paperboard container has a fiber tear of 90% or greater when the container seams are separated.

23. A coated paperboard container for holding hot beverages, comprising:

a sidewall comprising:

a sidewall paperboard substrate having an interior surface facing an interior of said container and an exterior surface facing an exterior of said container, an upper end, a lower end, a first longitudinal end, and a second longitudinal end;

a first aqueous barrier coating on the interior surface of the sidewall paperboard substrate, wherein the first aqueous barrier coating consists essentially of binder and pigment, wherein the first longitudinal end of the sidewall paperboard substrate is heat sealed, by way of the first aqueous barrier coating, to the second longitudinal end of the sidewall paperboard substrate to form a sidewall seam; and a non-barrier coating on the exterior surface of the sidewall paperboard substrate, wherein the coated paperboard container has a repulpability yield of 75% or greater, a side seam bond strength of 30 pounds per inch or greater, and a wet rigidity loss of 20% or less.

24. The coated paperboard container for holding hot beverages of claim 23, wherein the coated paperboard container has a repulpability yield of 80% accepts or greater.

25. The coated paperboard container for holding hot beverages of claim 23, wherein the coated paperboard container has a repulpability yield of 85% accepts or greater.

26. The coated paperboard container for holding hot beverages of claim 23, wherein the coated paperboard container has a repulpability yield of 90% accepts or greater.

27. The coated paperboard container for holding hot beverages of claim 23, wherein the coated paperboard container has a sidewall seam bond strength of 40 pounds per inch or greater.

28. The coated paperboard container for holding hot beverages of claim 23, wherein the coated paperboard container has a sidewall seam bond strength of 50 pounds per inch or greater.

29. The coated paperboard container for holding hot beverages of claim 23, wherein the coated paperboard container has a wet rigidity loss of 10% or less.

30. The coated paperboard container for holding hot beverages of claim 23, wherein the coated paperboard container has a 30 minute water Cobb test of 20 $g/m^2$ or less.

31. The coated paperboard container for holding hot beverages of claim 23, wherein the coated paperboard container has a 30 minute water Cobb test of 10 $g/m^2$ or less.

32. The coated paperboard container for holding hot beverages of claim 23, wherein the coated paperboard container has a 30 minute water Cobb test of 5 $g/m^2$ or less.

33. The coated paperboard container for holding hot beverages of claim 23, wherein the coated paperboard container has a staining brightness loss of 20% or less.

34. The coated paperboard container for holding hot beverages of claim 23, wherein the coated paperboard container has a staining brightness loss of 10% or less.

35. The coated paperboard container for holding hot beverages of claim 23, wherein the coated paperboard container has a staining brightness loss of 5% or less.

36. The coated paperboard container for holding hot beverages of claim 23, wherein the coated paperboard container has a blocking rating of 3.5 or less.

37. The coated paperboard container for holding hot beverages of claim 23, wherein the coated paperboard container has a blocking rating of 3.0 or less.

38. The coated paperboard container for holding hot beverages of claim 23, wherein the coated paperboard container has a blocking rating of 2.0 or less.

39. The coated paperboard container for holding hot beverages of claim 23, wherein the coated paperboard container has a fiber tear of 80% or greater when the container seams are separated.

40. The coated paperboard container for holding hot beverages of claim 23, wherein the coated paperboard container has a fiber tear of 90% or greater when the container seams are separated.

41. The coated paperboard container for holding hot beverages of claim 23 further comprising:

a bottom wall comprising:

a bottom stock paperboard substrate having an interior surface facing an interior of said container and an exterior surface facing an exterior of said container;

an aqueous barrier coating on the interior surface of the bottom stock paperboard substrate; and at least one of a second aqueous barrier coating and a non-barrier coating on the exterior surface of the bottom stock paperboard substrate, wherein a circumferential portion of the bottom stock paperboard substrate is heat sealed, by way at least one of the aqueous barrier coating of the sidewall and the aqueous barrier coating of the bottom wall, to the lower end of the sidewall paperboard substrate.

42. The coated paperboard container for holding hot beverages of claim 41 wherein the lower end of the sidewall paperboard substrate is folded towards the interior of the coated paperboard container to form a circumferential recess, wherein a circumferential edge of the bottom stock paperboard substrate is folded towards the exterior surface to form a circumferential lip, and wherein the circumferential lip of the bottom wall is disposed in the circumferential recess of the sidewall.

43. The coated paperboard container for holding hot beverages of claim 41 wherein the at least one of a second aqueous barrier coating and a non-barrier coating on the exterior surface of the bottom stock paperboard substrate comprises the non-barrier coating on the exterior surface of the bottom stock paperboard substrate.

44. The coated paperboard container for holding hot beverages of claim 41 wherein the at least one of a second aqueous barrier coating and a non-barrier coating on the exterior surface of the bottom stock paperboard substrate comprises the second aqueous barrier coating on the exterior surface of the bottom stock paperboard substrate.

45. The coated paperboard container for holding hot beverages of claim 41 wherein the at least one of a second aqueous barrier coating and a non-barrier coating on the exterior surface of the bottom stock paperboard substrate comprises the second aqueous barrier coating on the exterior surface of the bottom stock paperboard substrate and the non-barrier coating on the second aqueous barrier coating.

46. A coated paperboard container for holding cold beverages, comprising:

a sidewall comprising:

a sidewall paperboard substrate having an interior surface facing an interior of said container and an exterior surface facing an exterior of said container, an upper end, a lower end, a first longitudinal end, and a second longitudinal end;

a first aqueous barrier coating on the interior surface of the sidewall paperboard substrate, wherein the first aqueous barrier coating consists essentially of binder and pigment; and a second aqueous barrier coating on the exterior surface of the sidewall paperboard substrate, wherein the second aqueous barrier coating consists essentially of binder and pigment, wherein the first longitudinal end of the sidewall paperboard substrate is heat sealed, by way of at least one of the first aqueous barrier coating and the second aqueous barrier coating, to the second longitudinal end of the sidewall paperboard substrate to form a sidewall seam, wherein the coated paperboard container has a repulpability yield of 75% or greater, a side seam bond strength of 30 pounds per inch or greater, and a wet rigidity loss of 50% or less.

47. The coated paperboard container for holding cold beverages of claim 46, wherein the coated paperboard container has a repulpability yield of 80% accepts or greater.

48. The coated paperboard container for holding cold beverages of claim 46, wherein the coated paperboard container has a repulpability yield of 85% accepts or greater.

49. The coated paperboard container for holding cold beverages of claim 46, wherein the coated paperboard container has a repulpability yield of 90% accepts or greater.

50. The coated paperboard container for holding cold beverages of claim 46, wherein the coated paperboard container has a sidewall seam bond strength of 40 pounds per inch or greater.

51. The coated paperboard container for holding cold beverages of claim 46, wherein the coated paperboard container has a sidewall seam bond strength of 50 pounds per inch or greater.

52. The coated paperboard container for holding cold beverages of claim 46, wherein the coated paperboard container has a wet rigidity loss of 40% or less.

53. The coated paperboard container for holding cold beverages of claim 46, wherein the coated paperboard container has a wet rigidity loss of 30% or less.

54. The coated paperboard container for holding cold beverages of claim 46, wherein the coated paperboard container has a wet rigidity loss of 20% or less.

55. The coated paperboard container for holding cold beverages of claim 46, wherein the coated paperboard container has a wet rigidity loss of 10% or less.

56. The coated paperboard container for holding cold beverages of claim 46, wherein the coated paperboard container has a 30 minute water Cobb test of 20 $g/m^2$ or less.

57. The coated paperboard container for holding cold beverages of claim 46, wherein the coated paperboard container has a 30 minute water Cobb test of 10 $g/m^2$ or less.

58. The coated paperboard container for holding cold beverages of claim 46, wherein the coated paperboard container has a 30 minute water Cobb test of 5 $g/m^2$ or less.

59. The coated paperboard container for holding cold beverages of claim 46, wherein the coated paperboard container has a staining brightness loss of 20% or less.

60. The coated paperboard container for holding cold beverages of claim 46, wherein the coated paperboard container has a staining brightness loss of 10% or less.

61. The coated paperboard container for holding cold beverages of claim 46, wherein the coated paperboard container has a staining brightness loss of 5% or less.

62. The coated paperboard container for holding cold beverages of claim 46, wherein the coated paperboard container has a blocking rating of 3.5 or less.

63. The coated paperboard container for holding cold beverages of claim 46, wherein the coated paperboard container has a blocking rating of 3.0 or less.

64. The coated paperboard container for holding cold beverages of claim 46, wherein the coated paperboard container has a blocking rating of 2.0 or less.

65. The coated paperboard container for holding cold beverages of claim 46, wherein the coated paperboard container has a fiber tear of 80% or greater when the container seams are separated.

66. The coated paperboard container for holding cold beverages of claim 46, wherein the coated paperboard container has a fiber tear of 90% or greater when the container seams are separated.

67. The coated paperboard container for holding cold beverages of claim 46 further comprising a non-barrier coating on the second aqueous barrier coating on the exterior surface of the sidewall paperboard substrate.

68. The coated paperboard container for holding cold beverages of claim 46 further comprising:

a bottom wall comprising:

a bottom stock paperboard substrate having an interior surface facing an interior of said container and an exterior surface facing an exterior of said container; and a first aqueous barrier coating on the interior surface of the bottom stock paperboard substrate;

a second aqueous barrier coating on the exterior surface of the bottom stock paperboard substrate, wherein a circumferential portion of the bottom stock paperboard substrate is heat sealed, by way at least one of the first aqueous barrier coating of the sidewall, the second aqueous barrier coating of the sidewall, the first aqueous barrier coating of the bottom wall, and the second aqueous barrier coating of the bottom wall, to the lower end of the sidewall paperboard substrate.

69. The coated paperboard container for holding cold beverages of claim 68 wherein the lower end of the sidewall paperboard substrate is folded towards the interior of the coated paperboard container to form a circumferential recess, wherein a circumferential edge of the bottom stock paperboard substrate is folded towards the exterior surface to form a circumferential lip, and wherein the circumferential lip of the bottom wall is disposed in the circumferential recess of the sidewall.

70. The coated paperboard container holding cold beverages of claim 68 further comprising a non-barrier coating on the second aqueous barrier coating on the exterior surface of the bottom stock paperboard substrate.

* * * * *